US009097463B2

(12) United States Patent
Hanzawa et al.

(10) Patent No.: US 9,097,463 B2
(45) Date of Patent: Aug. 4, 2015

(54) HOUSING FOR HEATING AND USE METHOD OF THE SAME, HEATING JIG AND USE METHOD OF THE SAME, AND OPERATION METHOD OF HEATING DEVICE

(75) Inventors: Shigeru Hanzawa, Kagamigahara (JP); Hiroyoshi Suzumura, Kasugai (JP); Tsutomu Yamamoto, Nissinn (JP)

(73) Assignee: NGK Insulators, Ltd., Nagoya (JP)

( * ) Notice: Subject to any disclaimer, the term of this patent is extended or adjusted under 35 U.S.C. 154(b) by 847 days.

(21) Appl. No.: 13/030,471

(22) Filed: Feb. 18, 2011

(65) Prior Publication Data

US 2011/0207068 A1 Aug. 25, 2011

(30) Foreign Application Priority Data

Feb. 23, 2010 (JP) ..... 2010-037876
Mar. 19, 2010 (JP) ..... 2010-063412

(51) Int. Cl.

| | |
|---|---|
| ***F27B 17/00*** | (2006.01) |
| ***F27D 5/00*** | (2006.01) |
| ***F27B 9/34*** | (2006.01) |
| ***F27B 13/10*** | (2006.01) |
| ***F27D 11/12*** | (2006.01) |

(52) U.S. Cl.

CPC ... *F27D 5/00* (2013.01); *F27B 9/34* (2013.01); *F27B 13/10* (2013.01); *F27B 17/0025* (2013.01); *F27D 11/12* (2013.01)

(58) Field of Classification Search

CPC ... F27D 5/0012; F27D 5/0006; F27D 5/0018; F27D 5/0025; F27D 5/00

USPC ..... 432/81, 249, 253, 258; 211/41.18, 194, 211/188; 108/53.1; 219/494, 441.1, 390; 118/728

See application file for complete search history.

(56) References Cited

U.S. PATENT DOCUMENTS

| | | | | |
|---|---|---|---|---|
| 1,890,978 | A * | 12/1932 | Fear | 432/241 |
| 4,692,930 | A * | 9/1987 | Radke et al. | 373/72 |
| 5,417,567 | A | 5/1995 | Peter | |
| 6,768,084 | B2 * | 7/2004 | Liu et al. | 219/390 |

(Continued)

FOREIGN PATENT DOCUMENTS

| | | |
|---|---|---|
| DE | 102008009254 A1 * | 8/2009 |
| JP | 63-303870 AI | 12/1988 |

(Continued)

OTHER PUBLICATIONS

Japanese Office Action (Application No. 2010-037876) dated Feb. 4, 2014.

*Primary Examiner* — Steven B McAllister
*Assistant Examiner* — Ko-Wei Lin
(74) *Attorney, Agent, or Firm* — Burr & Brown, PLLC

(57) ABSTRACT

A heating storage structure 1 includes a plurality of mounting parts 5 each including a mounting face 9 on which articles 31 to be heated are mounted, which is a part of the surface of the mounting part; and a fixing part 7 to which the plurality of mounting parts 5 are detachably fixed so that the plurality of mounting parts 5 are stacked while each of spaces $S_1$ to $S_4$ is left between the mounting face 9 of one of the mounting parts 5 and the mounting part 5 disposed adjacent to the one mounting part 5, and the plurality of mounting parts 5 include a mounting part 5*b* provided with the mounting face 9 having a thermal emissivity which is different from that of the mounting face 9 of another mounting part 5*a*.

14 Claims, 14 Drawing Sheets

(56) References Cited

U.S. PATENT DOCUMENTS

| | | | | |
|---|---|---|---|---|
| 6,808,391 | B2 * | 10/2004 | Yun | 432/249 |
| 6,864,466 | B2 * | 3/2005 | Porter et al. | 219/494 |
| 7,104,789 | B1 | 9/2006 | Robich et al. | |
| 7,562,694 | B2 * | 7/2009 | Connors et al. | 164/529 |
| 8,459,476 | B2 * | 6/2013 | Malekmadani | 211/188 |
| 2005/0046063 | A1 | 3/2005 | Toda et al. | |

FOREIGN PATENT DOCUMENTS

| | | | |
|---|---|---|---|
| JP | 10-311686 | A1 | 11/1998 |
| JP | 2003-212672 | A1 | 7/2003 |
| JP | 2004-225027 | A1 | 8/2004 |
| JP | 2007-270294 | A1 | 10/2007 |
| WO | 01/13054 | A1 | 2/2001 |

* cited by examiner

| SYMBOL | COMPOSITION(mass%) | POROSITY | Measurement temp |
|---|---|---|---|
| ▲ | SiC=98%, $SiO_2$= 2% | 17% | ORDINARY TEMP. |
| ■ | SiC=50%, $SiO_2$=50% | 27% | ORDINARY TEMP. |
| ◆ | SiC=98%, $SiO_2$=2% | 17% | 1000°C |
| ○ | $2MgO \cdot 2Al_2O_3 \cdot 5SiO_2$=100% | 29% | ORDINARY TEMP. |
| □ | $Al_2O_3$=92%, $SiO_2$=8% | 13% | ORDINARY TEMP. |
| △ | $Al_2O_3$=99%, $SiO_2$=1% | 1% | ORDINARY TEMP. |
| ◇ | $Al_2O_3$=92%, $SiO_2$=8% | 13% | 1000°C |

SURFACE TEMPERATURE
DURING INITIAL HEATING $T_a > T_b > T_c > T_d > T_e$

SURFACE TEMPERATURE
DURING INITIAL HEATING $T_f > T_g > T_h > T_i$

HOUSING FOR HEATING AND USE METHOD OF THE SAME, HEATING JIG AND USE METHOD OF THE SAME, AND OPERATION METHOD OF HEATING DEVICE

BACKGROUND OF THE INVENTION

1. Field of the Invention

The present invention relates to a housing for heating and a use method of the housing for heating, a heating jig and a use method of the jig, and an operation method of a heating device.

2. Description of the Related Art

A heating step is used in manufacturing various products. For example, there is broadly used a method of disposing a plate, a shelf assembly or the like on which a plurality of articles to be heated are mounted in a furnace to simultaneously heat the plurality of articles to be heated (e.g., Patent Document 1).

[Patent Document 1] JP-A-10-311686

However, when the plurality of articles to be heated, which are mounted on the plate or the shelf assembly, are simultaneously heated, the plate or the shelf assembly absorbs heat, whereby fluctuations are generated in an ambient temperature around the articles to be heated. In consequence, fluctuations are generated in the amount of heat received by the articles to be heated.

In view of the above problem, an object of the present invention is to provide a housing for heating which enables simultaneous heating of a plurality of articles to be heated and decreases a difference in the amount of heat received by the articles to be heated during the heating, a use method of the housing for heating, a heating jig and a use method of the jig, and an operation method of a heating device.

SUMMARY OF THE INVENTION

The present invention has been completed to achieve the above object. Specifically, there are provided a housing for heating and a use method of the housing for heating, a heating jig and a use method of the jig, and an operation method of a heating device as follows.

[1] A housing for heating comprising: a plurality of mounting parts each including a mounting face on which articles to be heated are mounted, which is a part of the surface of the mounting part; and a fixing part to which the plurality of mounting parts are detachably fixed so that the plurality of mounting parts are stacked while a space is left between the mounting face of one of the mounting parts and the mounting part disposed adjacent to the one mounting part, wherein the plurality of mounting parts include the mounting part provided with the mounting face having a thermal emissivity which is different from that of the mounting face of the other mounting part.

[2] The housing for heating according to the above [1], wherein the mounting part has a plate shape, and includes the mounting face on one of two front and back surfaces of the plate shape, and the plurality of mounting parts are stacked while a space is left between the mounting face of the one mounting part and the surface of the mounting part stacked above the one mounting part on a side opposite to the mounting face of the mounting part.

[3] The housing for heating according to the above [2], wherein the mounting face of the mounting part having the plate shape has a thermal emissivity which is equal to that of the surface of the mounting part opposite to the mounting face thereof.

[4] The housing for heating according to any one of the above [1] to [3], further comprising a plurality of units each including the mounting part and the fixing part combined with the mounting part, wherein the fixing part of one of the units is detachably connected to the other unit so that the plurality of units are stacked while a space is left between the mounting face of the one unit and the unit disposed adjacent to the one unit.

[5] A use method of the housing for heating according to any one of the above [1] to [4], comprising the steps of: in case of mounting the articles to be heated on the mounting faces of the mounting parts to house the articles to be heated in the housing for heating and heating the articles to be heated together with the housing for heating by heating means, stacking the plurality of mounting parts so that the ascending order of the size of the thermal emissivity of the mounting face of each of the mounting parts corresponds to the descending order of the rise/fall of an ambient temperature in a facing space of the mounting face, to use the mounting parts.

[6] A use method of the housing for heating according to any one of the above [1] to [4], comprising the steps of: mounting the articles to be heated on the mounting faces of the plurality of mounting parts to house the articles to be heated in the housing for heating while stacking the mounting parts so that the thermal emissivity of the mounting face of each of the mounting parts is not less than the thermal emissivity of the mounting face of the mounting part stacked above each of the mounting parts; storing the housing for heating in a storage chamber surrounded by a wall part; and raising an ambient temperature in the storage chamber to heat the articles to be heated together with the housing for heating.

[7] An operation method of a heating device comprising the housing for heating according to any one of the above [1] to [4], a storage section which stores the housing for heating in a storage chamber surrounded by a wall part having an inner wall surface made of a material having a thermal emissivity of 0.7 or more at a wavelength of 1.6 to 2.6 μm, ambient temperature measuring means for measuring an ambient temperature in the storage chamber, temperature distribution measurement means for measuring a temperature distribution in the article to be heated, and heating means for heating the inside of the storage chamber while controlling a temperature rise speed of the ambient temperature based on the ambient temperature measured by the ambient temperature measuring means and the temperature distribution measured by the temperature distribution measuring means, the method comprising the steps of: storing, in the storage chamber of the storage section, the housing for heating in which the articles to be heated are mounted; and heating the inside of the storage chamber by the heating means while controlling the temperature rise speed of the ambient temperature so that the temperature distribution in the article to be heated measured by the temperature distribution measuring means is from 0.9 to 1.0 time a maximum allowable value, when the ambient temperature measuring means measures the ambient temperature having the maximum allowable value of the temperature distribution in the article to be heated, which is determined so that any defect is not generated in the articles to be heated.

[8] The operation method of the heating device according to the above [7], further comprising the steps of: raising the ambient temperature so that the temperature reaches 750° C. or higher.

[9] The operation method of the heating device according to the above [7] or [8], wherein the inner wall surface is made of a material including at least two main components selected from the group consisting of silicon carbide (SiC), titanium oxide ($TiO_2$ or TiO) and silica ($SiO_2$).

[10] The operation method of the heating device according to the above [7] or [8], wherein the wall part includes an inner wall member constituting the inner wall surface, and a supporter with which the inner wall member is lined, and the inner wall member has a thickness of 0.1 to 3.0 mm and is made of a material containing at least two main components selected from the group consisting of silicon carbide (SiC), titanium oxide ($TiO_2$ or TiO) and silica ($SiO_2$).

[11] A heating jig comprising a mounting part having a plate shape and including one of two front and back surfaces as a mounting face on which articles to be heated are mounted, wherein the thermal emissivity of the center of the mounting face is larger than that of an edge side portion of the mounting face.

[12] The heating jig according to the above [11], wherein the mounting part includes a plurality of members having a plate shape, and the mounting face is formed by aligning and contacting with, substantially on the same plane, one of the two front and back surfaces of each of the plurality of members having the plate shape.

[13] A use method of the heating jig according to any one of the above [11] or [12], comprising the steps of: storing the heating jig having the mounting face on which the articles to be heated are mounted in a storage chamber surrounded by a wall part; and heating the heating jig together with the articles to be heated by radiant-heat transfer from the wall part.

[14] An operation method of a heating device comprising the heating jig according to the above [11] or [12], a storage section which contains the heating jig in a storage chamber surrounded by a wall part having an inner wall surface made of a material having a thermal emissivity of 0.7 or more at a wavelength of 1.6 to 2.6 μm, ambient temperature measuring means for measuring an ambient temperature in the storage chamber, temperature distribution measurement means for measuring a temperature distribution in the article to be heated, and heating means for heating the inside of the storage chamber while controlling a temperature rise speed of the ambient temperature based on the ambient temperature measured by the ambient temperature measuring means and the temperature distribution measured by the temperature distribution measuring means, the method comprising the steps of: storing, in the storage chamber of the storage section, the heating jig on which the articles to be heated are mounted; and heating the inside of the storage chamber by the heating means while controlling the temperature rise speed of the ambient temperature so that the temperature distribution in the article to be heated measured by the temperature distribution measuring means is from 0.9 to 1.0 time a maximum allowable value, when the ambient temperature measuring means measures the ambient temperature having the maximum allowable value of the temperature distribution in the article to be heated, which is determined so that any defect is not generated in the articles to be heated.

[15] The operation method of the heating device according to the above [14], further comprising the steps of: raising the ambient temperature so that the temperature reaches 750° C. or higher.

[16] The operation method of the heating device according to the above [14] or [15], wherein the inner wall surface is made of a material including at least two main components selected from the group consisting of silicon carbide (SiC), titanium oxide ($TiO_2$ or TiO) and silica ($SiO_2$).

[17] The operation method of the heating device according to the above [14] or [15], wherein the wall part includes an inner wall member constituting the inner wall surface, and a supporter with which the inner wall member is lined, and the inner wall member has a thickness of 0.1 to 3.0 mm and is made of a material containing at least two main components selected from the group consisting of silicon carbide (SiC), titanium oxide ($TiO_2$ or TiO) and silica ($SiO_2$).

The housing for heating of the present invention enables simultaneous heating of a plurality of articles to be heated, and can decrease a difference in the amount of heat received by the articles to be heated during the heating. The use method of the housing for heating of the present invention can simultaneously heat the plurality of articles to be heated and decrease the difference in the amount of the heat received by the articles to be heated during the heating.

The heating jig of the present invention enables the simultaneous heating of the plurality of articles to be heated, and can decrease the difference in the amount of the heat received by the articles to be heated during the heating. The use method of the heating jig of the present invention can simultaneously heat the plurality of articles to be heated and decrease the difference in the amount of the heat received by the articles to be heated during the heating.

The operation method of the heating device of the present invention heats the articles to be heated in the storage chamber surrounded by the inner wall surface made of the material having a high thermal emissivity, to decrease the difference in the amount of the heat received by the articles to be heated, thereby easily obtaining a uniform temperature in the articles to be heated. Furthermore, the operation method of the heating device of the present invention can increase the temperature rise speed of the ambient temperature in the storage chamber as much as possible. When the temperature rise speed is increased in this manner, the efficiency of energy required for temperature rise can be improved, and generation of a defective article to be heated can be minimized.

DETAILED DESCRIPTION OF THE INVENTION

Figure 1:
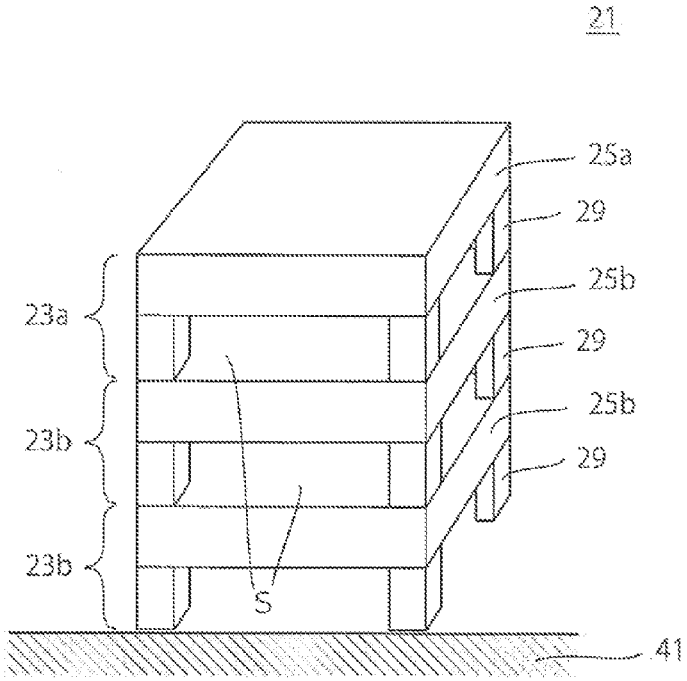
FIG. 1 is a perspective view of a shelf assembly according to one embodiment of a housing for heating of the present invention.

Hereinafter, embodiments of the present invention will be described with reference to the drawings. The present invention is not limited to the following embodiments, and alteration, modification or improvement can be added to the embodiments without departing from the scope of the present invention.

1. Housing for Heating:

A housing for heating of the present invention comprises a plurality of mounting parts each having a mounting face on which articles to be heated are mounted, which is a part of the surface of the mounting part; and a fixing part to which the plurality of mounting parts are detachably fixed so that the plurality of mounting parts are stacked while a space is left between the mounting face of one of the mounting parts and the mounting part disposed adjacent to the one mounting part, characterized in that the plurality of mounting parts include the mounting part provided with the mounting face having a thermal emissivity which is different from that of the mounting face of the other mounting part.

In the housing for heating of the present invention, it is possible to mount the articles to be heated on the mounting faces of the plurality of mounting parts. Therefore, the housing for heating of the present invention can house a plurality of articles to be heated. Moreover, the housing for heating of the present invention can contain the plurality of articles to be heated to simultaneously heat the articles, and can, accordingly, improve productivity.

In the housing for heating of the present invention, an ambient temperature in a space where the articles to be heated are housed varies with each space sometimes. In such a case, when the articles to be heated are housed in the space having a high ambient temperature, the articles to be heated receive a large amount of heat from an ambient gas. When the articles to be heated are housed in the space having a low ambient temperature, the articles to be heated receive a small amount of heat from the ambient gas.

To cope with the above situation, in the housing for heating of the present invention, the order of the mounting parts may be determined so as to increase the thermal emissivity of the mounting face facing the space where the ambient temperature lowers during the heating and decrease the thermal emissivity of the mounting face facing the space where the ambient temperature rises (described later in detail). When the order of the mounting parts is determined in this manner, it is possible to transfer a large amount of heat to the article to be heated which receives less heat from the ambient gas, by radiant heat transfer from the mounting face. Moreover, it is possible to only transfer a small amount of heat to the article to be heated which receives more heat from the ambient gas, by the radiant heat transfer from the mounting face. Therefore, in a case where a plurality of articles to be heated are housed and heated in the housing for heating of the present invention, a difference in the amount of the heat received by the articles to be heated can be decreased.

In the housing for heating of the present invention, the mounting part has a plate shape, and includes the mounting face on one of two front and back surfaces of the plate shape, and the plurality of mounting parts are stacked while a space is left between the mounting face of the one mounting part and the surface of the mounting part stacked above the one mounting part on a side opposite to the mounting face of the mounting part.

In this embodiment, the two front and back surfaces of the mounting part having the plate shape face the spaces where the articles to be heated are housed, and hence the mounting part easily receives the heat from the ambient gas in the spaces where the articles to be heated are housed. Therefore, the mounting part can efficiently transfer the heat absorbed from the ambient gas to the articles to be heated by the radian heat transfer. Furthermore, the mounting part having the plate shape is preferably made thin. In this case, the heat capacity of the mounting part lowers, and hence the temperature of the mounting part rapidly rises. In consequence, it is possible to more efficiently transfer the radiant heat from the mounting part to the articles to be heated.

Furthermore, in the embodiment including the mounting part having the above plate shape, the mounting face of the mounting part has a thermal emissivity which is equal to that of the surface of the mounting part opposite to the mounting face thereof.

In this embodiment, when the mounting part is provided with the mounting face having a high thermal emissivity, the opposite surface of the mounting part also has a high thermal emissivity. The high thermal emissivity means a high thermal absorptivity. Therefore, when the thermal emissivity of the mounting face is high, the mounting face and the opposite surface absorb much heat, whereby the mounting part can accumulate a large amount of heat. In consequence, the mounting part can transfer a large amount of heat to the articles to be heated by the radiant heat transfer. When the thermal emissivity of the mounting face is low, the mounting face and the opposite surface only absorb a small amount of heat, and hence the amount of the heat accumulated in the mounting part also decreases. In consequence, the mounting part only transfers a small amount of heat to the articles to be heated. Therefore, in this embodiment, a difference between the high thermal emissivity and the low thermal emissivity of the mounting face can more clearly be reflected in the difference in the amount of the heat transferred from the mounting part to the articles to be heated.

The housing for heating of the present invention preferably comprises a plurality of units each including the mounting part and the fixing part combined with the mounting part, and the fixing part of one of the units is detachably connected to the other unit so that the plurality of units are stacked while a space is left between the mounting face of the one unit and the unit disposed adjacent to the one unit.

In this embodiment, the attaching/detaching of the unit constituting the housing for heating and the changing of arrangement of the units can easily be performed. Therefore, in this embodiment, when heating conditions in an electric furnace are changed, it is possible to easily cope with the change of the conditions by changing the arrangement of the units or the like. Moreover, when the housing for heating is stored and heated in the electric furnace, the articles to be heated can beforehand be mounted on the mounting faces outside the electric furnace, moved, as they are, into the electric furnace, and rapidly heated.

Hereinafter, a specific example of the embodiment of the housing for heating of the present invention will be described to explain contents of the housing for heating of the present invention in detail.

Figure 2:
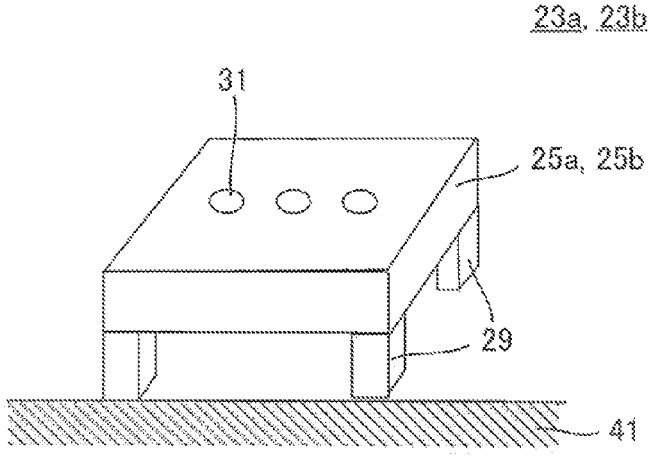
FIG. 2 is a perspective view of one shelf constituting the shelf assembly shown in FIG. 1.

FIG. 1 is a perspective view of a shelf assembly 21 which is one embodiment of the heating storage structure of the present invention. FIG. 2 is a perspective view of one shelf 23*a* or 23*b* constituting the shelf assembly 21 shown in FIG. 1.

The embodiment will be described with reference to FIG. 2. The shelf 23*a* or 23*b* has a shelf plate 25*a* or 25*b* and supporters 29. The supporters 29 are attached to one of two front and back surfaces of the shelf plate 25*a* or 25*b* . Moreover, here, thermal emissivity $\epsilon_a$ of the surface of the shelf plate 25*a* is smaller than thermal emissivity $\epsilon_b$ of the shelf plate 25*b* . Articles 31 to be heated can be mounted on the shelf plate 25*a* or 25*b* of the shelf 23*a* or 23*b*.

In the shelf assembly 21 shown in FIG. 1, the shelf 23*b* is stacked on a floor 41, another shelf 23*b* is stacked on the shelf plate 25*b* of the shelf 23*b*, and the shelf 23*a* is further stacked thereon. Moreover, the supporters 29 are sandwiched between the shelf plate 25*a* and the shelf plate 25*b* , and hence a space S can be formed between the shelf plate 25*a* and the shelf plate 25*b*.

Moreover, the shelves 23*a* and 23*b* may be stacked with a posture where the supporters 29 are disposed on the upside and the shelf plates 25*a* and 25*b* are disposed on the downside (not shown). For example, on the supporters 29 of the shelf 23*a*, the shelf plate 25*b* of another shelf 23*b* may be stacked. In this case, the shelf assembly 21 shown in FIG. 1 is disposed upside down. In this state, the lower surface (the surface which is not connected to the supporters 29) of the shelf plate 25*a* of the lowermost shelf 23*a* entirely comes in contact with the floor 41 (not shown), so that the lowermost shelf plate 25*a* directly receives heat from the floor 41. From viewpoints that the shelf plates 25*a* and 25*b* can receive the heat in the same manner and that a difference in temperature between the shelf plate 25*a* and the shelf plate 25*b* is decreased, as shown in FIGS. 1 and 2, the supporters 29 are preferably installed on the floor 41 so that the shelf plates 25*a* and 25*b* do not directly come in contact with the floor 41.

Figure 4:
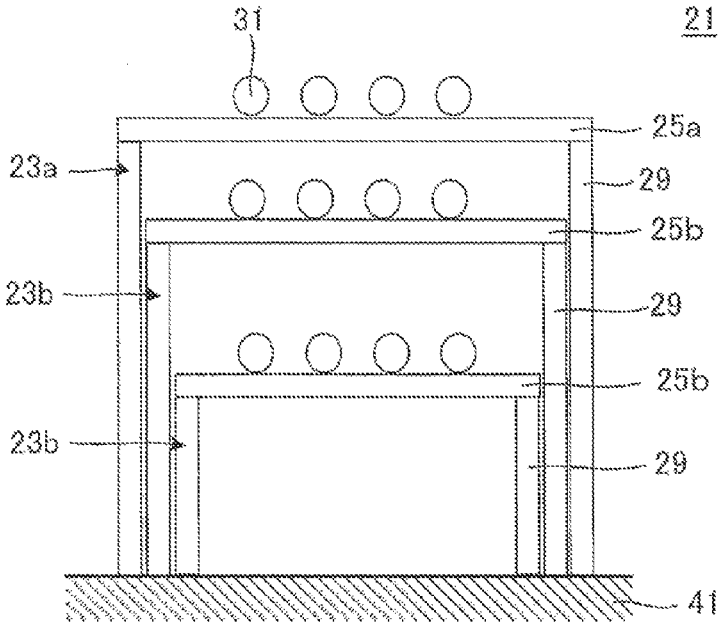
FIG. 4 is an exemplary diagram of another shelf assembly according to the embodiment of the housing for heating of the present invention.

FIG. 4 is an exemplary diagram of another example of the shelf assembly 21. In the shelf assembly 21, each of the shelf plates 25*a* and 25*b* is fixed at a predetermined height from the floor 41 by the supporters 29. Furthermore, the shelves 23*a* and 23*b* have different lengths of the supporters 29. In consequence, even if another shelf is not stacked on the shelf, the shelf plates 25*a* and 25*b* can be stacked with a space being sandwiched therebetween.

Figure 5:
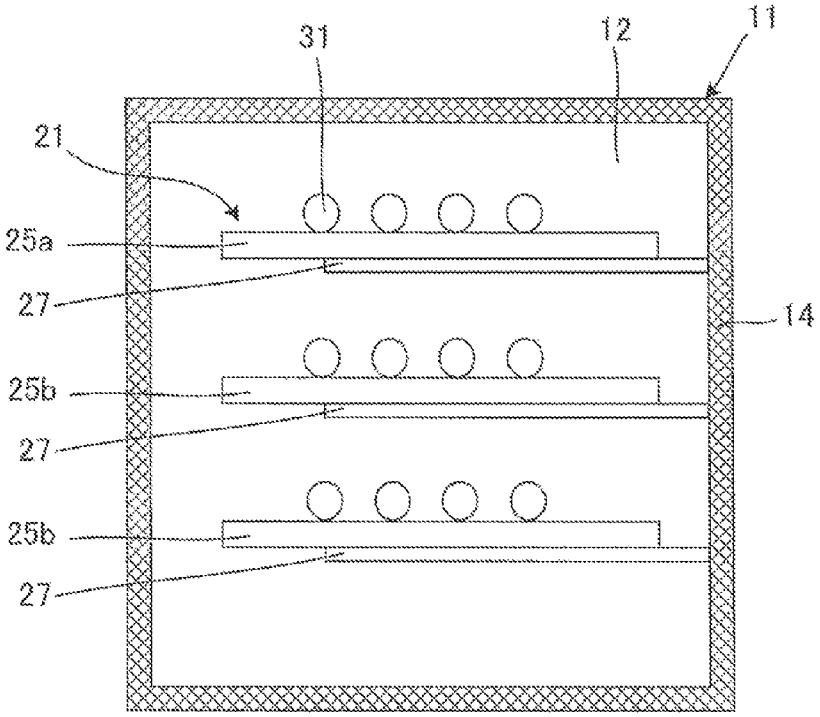
FIG. 5 is an exemplary diagram of a furnace in which the shelf assembly according to the embodiment of the housing for heating of the present invention is stored.

FIG. 5 is an exemplary diagram of a furnace 11 in which the shelf assembly 21 is set. From a furnace wall 14, a plurality of receiving portions 27 project. Furthermore, the plurality of receiving portions 27 are vertically arranged. The shelf plates 25*a* and 25*b* are held by the receiving portions 27, respectively, whereby it is possible to prepare the shelf assembly 21 in which the plurality of shelf plates 25*a* and 25*b* are stacked with a space being sandwiched therebetween. The shelf assembly 21 is constituted of the shelf plates 25*a* and 25*b* , and the receiving portions 27 are formed substantially integrally with the furnace wall 14.

Figure 6:
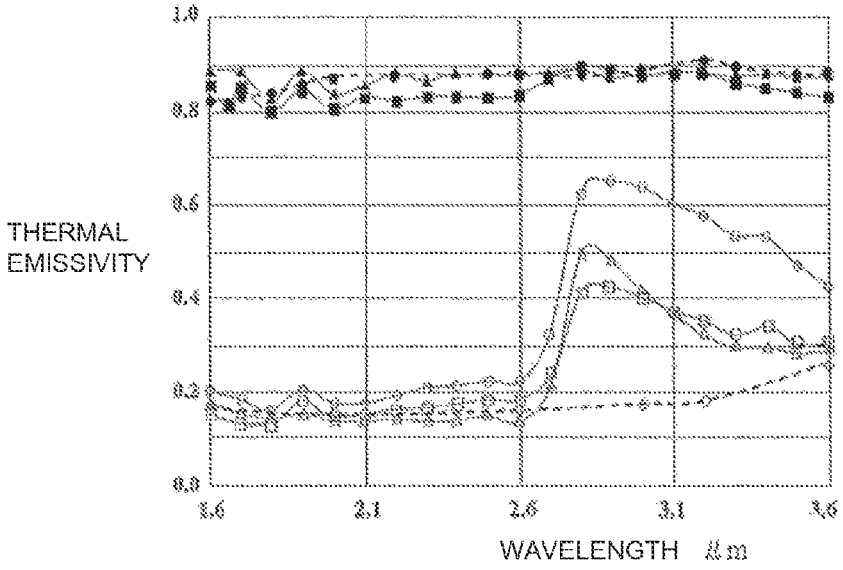
FIG. 6 is a diagram showing thermal emissivities of various materials at a wavelength of 1.6 to 3.6 μm.

FIG. 6 shows thermal emissivities of various materials measured by the present inventors at a wavelength of 1.6 to 3.6 μm. The thermal emissivity of silicon carbide and $SiO_2$ (this is present as an oxidation film on the surface of silicon carbide) (SiC=98 mass %, $SiO_2$=2 mass %, and porosity of 17%) is shown by "black triangle" at ordinary temperature (25° C.) and "black circle" at 1000° C. The thermal emissivity of a mixture of titanium oxide and $SiO_2$ (TiO=50 mass %, $SiO_2$=50 mass %, and porosity of 20%) at ordinary temperature (25° C.) is shown by "black square". The thermal emissivity of cordierite ($2MgO/2Al_2O_3/5SiO_2$=100 mass %, and porosity of 20%) at ordinary temperature (25° C.) is shown by "white circle". The thermal emissivity of an alumina material ($Al_2O_3$=92 mass %, $SiO_2$=8 mass %, and porosity of 15%) is shown by "white square" at ordinary temperature (25° C.) and "white rhombus" at 1000° C. The thermal emissivity of an alumina material ($Al_2O_3$=99 mass %, $SiO_2$=1 mass %, and porosity of 1%) at ordinary temperature (25° C.) is shown by "white triangle". The thermal emissivity of silicon carbide and $SiO_2$, or titanium oxide and $SiO_2$ at a wavelength of 1.6 to 2.6 μm is from about 0.8 to about 0.9 at both ordinary temperature (25° C.) and high temperature (1000° C.). On the other hand, the thermal emissivity of cordierite, or the alumina material of alumina and $SiO_2$ at a wavelength of 1.6 to 2.6 μm is from about 0.1 to about 0.25 at both ordinary temperature (25° C.) and high temperature (1000° C.)

The radiant heat transfer is a phenomenon where heat is transferred from a high-temperature body to a low-temperature body by radiation and absorption. The thermal emissivity varies depending on the type of a substance, the temperature of the substance, or a wavelength. Therefore, the amount of the heat transferred by the radiant heat transfer, so-called the radiant heat transfer amount is determined by a complicated phenomenon where a plurality of factors are entwined.

Considering from a relation between the radiant heat amount from a black body having a thermal emissivity of 1 and a wavelength peak, the wavelength at which the radiant heat amount at 1000° C. reaches a peak is, for example, 2.3 μm. Similarly, the wavelength at which the radiant heat amount at 1250° C. reaches the peak is 1.9 μm, and the wavelength at which the amount at 1500° C. reaches the peak is 1.6 μm (not shown). Therefore, it can be understood from analysis of Planck's law that in a temperature range of the black body exceeding 1000° C., the thermal emissivity at a wavelength of 2.3 μm or less noticeably influences the radiant heat transfer, but it is well known that the black body is merely ideal.

An alumina refractory material is used in a structure material of a firing furnace (a refractory material for use in a furnace wall or the like) or a base material of the shelf assembly in which the articles to be heated are housed. Moreover, it is known that the thermal emissivity of the alumina refractory material is 0.65 (e.g., refer to "Journal of Chemical Engineering of Japan" (issued by Maruzen Co., Ltd.)). Heretofore, when the articles to be heated are heated by using the structure material of the firing furnace or the shelf assembly made of the alumina refractory material, the thermal emissivity of the alumina refractory material is 0.65. Therefore, it is not necessary to control the thermal emissivity by use of a material other than the alumina refractory material. It has been considered that a temperature distribution is inevitably generated in the shelf assembly or the like.

However, from the measurement results of the emissivities of the alumina refractory material, SiC containing $SiO_2$ and titanium oxide containing $SiO_2$ in a wavelength range around 2 μm, as shown in FIG. 6, the present inventors have confirmed that the thermal emissivities in this wavelength range are different from values described in the above document or the like (specific numeric values of the thermal emissivity have been described above).

Therefore, the present inventors have focused on the thermal emissivity of the housing for heating in which the articles to be heated are disposed (e.g., the shelf assembly for heating) being regulated when heating the articles to be heated, and have intended to further decrease the width of the temperature distribution generated in the shelf assembly or the like.

For example, the thermal emissivity of the alumina material is different from that of the mixture of titanium oxide and $SiO_2$. Therefore, the shelf assembly 21 shown in FIGS. 1, 4 and 5 described above can be obtained by assembling the shelf 23*a* having the shelf plate 25*a* made of the alumina material and the shelf 23*b* having the shelf plate 25*b* made of the mixture of titanium oxide and $SiO_2$.

Alternatively, the shelf plate 25*b* may be prepared by coating the surface of the shelf plate 25*a* with a coat layer made of the mixture of titanium oxide and $SiO_2$. In this case, the mixture of titanium oxide and $SiO_2$ is easily adsorbed by the alumina material, and hence the coat layer made of the mixture of titanium oxide and $SiO_2$ does not easily peel from the surface of the shelf plate 25*a* made of the alumina material. Moreover, when the shelf plate 25*b* is prepared from the shelf plate 25*a* as described above, a weight or a heat capacity only slightly increases as much as the coating layer.

A use method can be applied to the above housing for heating (hereinafter referred to as "the use method of the housing for heating of the present invention") as follows.

2. Use Method of Housing for Heating:

A first embodiment of the use method of the housing for heating of the present invention uses the above housing for heating, and is characterized by, in case of mounting the articles to be heated on the mounting faces of the mounting parts to house the articles to be heated in the housing for heating and heating the articles to be heated together with the housing for heating by heating means, stacking the plurality of mounting parts so that the ascending order of the size of a thermal emissivity of the mounting face of each of the mounting parts corresponds to the descending order of the rise/fall of an ambient temperature in a facing space of the mounting face, to use the mounting parts.

In this first embodiment, when the articles to be heated receive a small amount of heat from the ambient gas, the articles receive a large amount of heat by radiant heat transfer from the mounting face. Moreover, when the articles to be heated receive a large amount of heat from the ambient gas, the articles receive a small amount of heat by the radiant heat transfer from the mounting face. Therefore, in the first embodiment of the use method of the housing for heating of the present invention, a difference in the total amount of the heat received by the articles to be heated from the ambient gas and the mounting face decreases among the articles to be heated. Therefore, it is possible to suppress uneven heating in all the articles to be simultaneously heated.

Furthermore, in this first embodiment, since the uneven heating can be suppressed, any heat does not have to be transferred to the articles to be heated over time so that the width of the temperature distribution in the article to be heated is not enlarged (e.g., in case of the heating by use of the furnace, the temperature rise speed of an in-furnace ambient temperature does not have to be minimized). In consequence, productivity improves, and a degree of freedom in a temperature profile during the heating enlarges (e.g., in the case of the heating by use of the furnace, the set range of the rise/fall of the temperature rise speed of the in-furnace ambient temperature enlarges).

A second embodiment of the use method of the housing for heating of the present invention uses the above housing for heating, and is characterized by mounting the articles to be heated on the mounting faces of the plurality of mounting parts to house the articles to be heated in the housing for heating while stacking the mounting parts so that the thermal emissivity of the mounting face of each of the mounting parts is not less than the thermal emissivity of the mounting face of the mounting part stacked above each of the mounting parts; storing the housing for heating in a storage chamber surrounded by a wall part; and raising an ambient temperature in the storage chamber to heat the articles to be heated together with the housing for heating.

When the temperature of the ambient gas in the storage chamber rises, the gas flows upwards. Therefore, the articles to be heated on the upper mounting part receive a large amount of heat from the ambient gas. In the second embodiment, the thermal emissivity of each mounting face is equal to or larger than that of the lower mounting face, so that variability of the amount of the heat received from the ambient gas can be eliminated. That is, when the articles to be heated receive a small amount of heat from the ambient gas, the articles receive a large amount of heat by the radiant heat transfer from the mounting face. When the articles receive a large amount of heat from the ambient gas, the articles receive a small amount of heat by the radiant heat transfer from the mounting face.

Therefore, in the second embodiment of the use method of the housing for heating of the present invention, a difference in the total amount of the heat received by the articles to be heated from the ambient gas and the mounting face decreases among the articles to be heated. In consequence, it is possible to suppress the heating unevenness in all the articles to be simultaneously heated.

Also in this second embodiment, since the uneven heating can be suppressed, any heat does not have to be transferred to the articles to be heated over time so that the width of the temperature distribution in the article to be heated is not enlarged (e.g., the temperature rise speed of an ambient temperature in the storage chamber does not have to be minimized). In consequence, productivity improves, and a degree of freedom in a temperature profile (e.g., a heat curve of the ambient temperature in the storage chamber) during the heating enlarges.

Hereinafter, a specific example of the embodiment of the use method of the housing for heating of the present invention will be described to explain contents of the use method of the housing for heating of the present invention in more detail.

Figure 3:
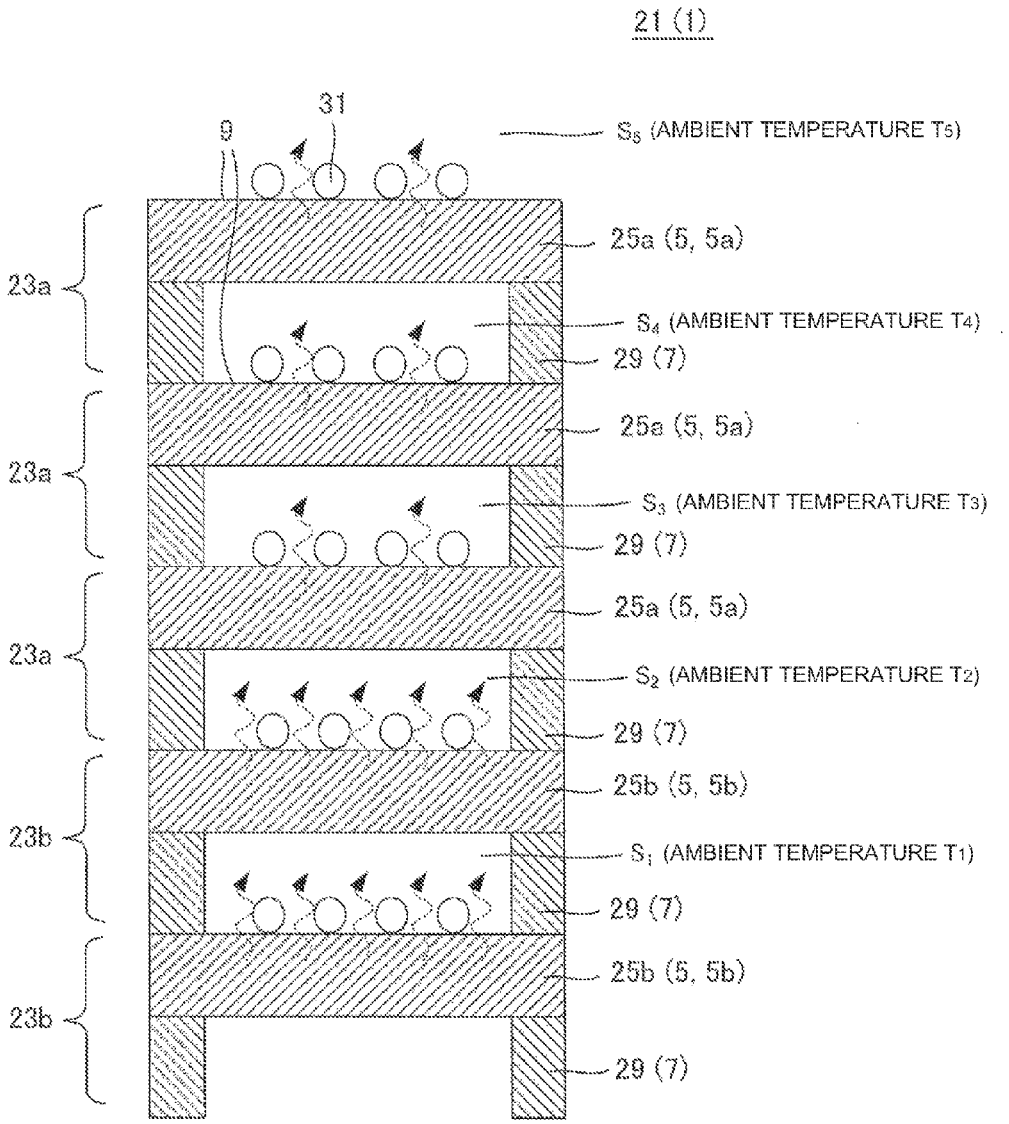
FIG. 3 is a sectional view of the shelf assembly in which shelves shown in FIG. 2 are stacked in five stages.

FIG. 3 is a sectional view of the shelf assembly 21 in which the shelves 23*a* and 23*b* shown in FIG. 2 are stacked in five stages in total. Here, spaces on the shelf plates 25*a* and 25*b* are spaces $S_1$ to $S_5$ from the lower stage to the upper stage. The ambient gas having a higher temperature flows upwards, and hence temperatures $T_1$ to $T_5$ of the ambient gas in the spaces $S_1$ to $S_5$ have a relation of $T_5>T_4>T_3>T_2>T_1$. In the shelf assembly 21, the shelf plates 25*a* are stacked in three upper stages, and the shelf plates 25*b* are stacked in two lower stages. Here, when the thermal emissivity $\epsilon_a$ of the surface of the shelf plate 25*a* is smaller than the thermal emissivity $\epsilon_b$ of the surface of the shelf plate 25*b* ($\epsilon_a<\epsilon_b$), the thermal emissivities of the shelf plates 25*a* and 25*b* have a relation of $\epsilon_a=\epsilon_a=\epsilon_a<\epsilon_b=\epsilon_b$ from the upper stage to the lower stage. Moreover, the spaces $S_1$ to $S_5$ on the shelf plates 25*a* and 25*b* have a relation of $T_5>T_4>T_3>T_2>T_1$ from the upper stage to the lower stage. Therefore, the thermal emissivity of the shelf plate 25*a* or 25*b* increases from the upper stage to the lower stage, whereas the ambient temperature in the space on the shelf plate 25*a* or 25*b* lowers from the upper stage to the lower stage. That is, the ascending order of the size of the thermal emissivity of the mounting face corresponds to the descending order of the rise/fall of the ambient temperature in the facing space of each mounting face.

In the shelf assembly 21 shown in FIG. 3, the ambient temperatures $T_1$ and $T_2$ of the spaces $S_1$ and $S_2$ of two lower stages are low as compared with the ambient temperatures $T_3$ to $T_5$ of the spaces $S_3$ to $S_5$ of three upper stages. Therefore, the articles 31 to be heated on the shelf plate 25*b* receives a less amount of heat from the ambient gas in the spaces $S_1$ and $S_2$. However, since the thermal emissivity $\epsilon_b$ the shelf plate 25*b* is larger than the thermal emissivity $\epsilon_a$ of the shelf plate 25*a*, the articles 31 to be heated on the shelf plate 25*b* receive a large amount of heat by the radiant heat transfer from the shelf plate 25*b* on which the articles themselves are mounted, as compared with the articles 31 to be heated on the shelf plate 25*a*. Therefore, when the articles 31 to be heated on the shelf plates 25*a* and 25*b* are compared, a difference in the total of the amount of the heat received from the ambient gas and the amount of the heat received by the radiant heat transfer from the shelf plate on which the articles themselves are mounted becomes small.

3. Heating Jig and Use Method of Heating Jig:

A heating jig of the present invention includes a mounting part having a plate shape, and one of two front and back surfaces as a mounting face on which articles to be heated are mounted, and is characterized in that the thermal emissivity of the center portion of the mounting face is larger than that of an edge side portion of the mounting face.

The heating jig of the present invention is preferably used during heating in a configuration where the temperature of the edge side portion of the mounting part rises earlier than the temperature of the center portion of the mounting part (described later in detail). The heating jig is preferable, for example, in a case where a heat source is disposed so that the temperature of the edge side portion of the mounting part rises earlier than that of the center portion of the mounting part. In such a case, the article mounted on the edge side portion of the mounting face receives a larger amount of heat from the heat source as compared with the article mounted on the center portion of the mounting part. Moreover, in the heating jig of the present invention, the thermal emissivity of the center portion of the mounting face is larger than that of the edge side portion of the mounting face, whereby the center portion of the mounting face absorbs a larger amount of heat than the edge side portion of the mounting face. In consequence, the article mounted on the center portion of the mounting face receives a larger amount of heat by the radiant heat transfer from the mounting face, as compared with the article mounted on the edge side portion of the mounting face. Therefore, a difference in the total amount of the heat received by the article to be heated from the heat source and the mounting face becomes small between the article mounted on the center portion of the mounting face and the article mounted on the edge side portion of the mounting face.

In the heating jig of the present invention, the mounting part includes a plurality of members having a plate shape, and the mounting face is formed by arranging and combining, substantially on the same plane, one of the two front and back surfaces of each of the plurality of members having the plate shape. In this embodiment, the area of the mounting face can be enlarged, and hence more articles to be heated can simultaneously be heated. Moreover, the articles to be heated are beforehand mounted on the surfaces which are the mounting faces of the members having the plate shape, these members having the plate shape are separately moved into the furnace, and the members having the plate shape may be assembled to form the heating jig in the furnace. In this case, it is possible to cope with even a situation where there is not any operation space having a sufficient breadth outside the furnace.

In the heating jig of the present invention, an embodiment may be applied in which the center portion of one of the two front and back surfaces of each member having the plate shape and made of a first material is coated with a member made of a second material having a larger thermal emissivity than the first material, to set the thermal emissivity of the center portion of the mounting face to be larger than that of the edge side portion of the mounting face. When the center portion of the surface is coated with the second material, a membrane made of the second material may be formed by using a spray or the like. Examples of an advantage of such a case include an advantage that the case can easily be applied when the surface of the member having the plate shape has a complicated shape, and an advantage that a weight or a heat capacity only slightly increases as much as the film. For example, in an embodiment in which an alumina material is used as the first material and the mixture of titanium oxide and $SiO_2$ is used as the second material, the mixture of titanium oxide and $SiO_2$ is easily adsorbed by the alumina material, and hence the film made of the mixture of titanium oxide and $SiO_2$ does not easily peel from the alumina material. Moreover, when this embodiment is applied in the furnace and first heat history is received, the adsorbed mixture itself causes sticking and sintering by generation of a vitreous material owing to an influence of a micro amount of inevitable impurities included in the mixture itself and the alumina material between the adsorbed mixture and the alumina material. In consequence, peeling between the adsorbed mixture and the alumina material does not easily occur.

The use method of the heating jig of the present invention uses the above heating jig, and is characterized by heating the heating jig having the mounting face on which the articles to be heated are stored in a storage chamber surrounded by a wall part; and heating the heating jig together with the articles to be heated by radiant heat transfer from the wall part. In the use method of the heating jig of the present invention, the article mounted on the edge side portion of the mounting face receives a larger amount of heat by radiant heat from the wall part, as compared with the article mounted on the center portion of the mounting part. However, since the article mounted on the center portion of the mounting face receives a large amount of heat by the radiant heat transfer from the mounting face as compared with the article mounted on the edge side portion of the mounting face as described above, a difference in the total amount of the heat received by the article to be heated from the wall part and the mounting face becomes small between the article mounted on the center portion of the mounting face and the article mounted on the edge side portion of the mounting face.

Hereinafter, a specific example of the embodiment of the heating jig of the present invention will be described to explain contents of the heating jig and the use method of the heating jig of the present invention in detail.

Figure 7:
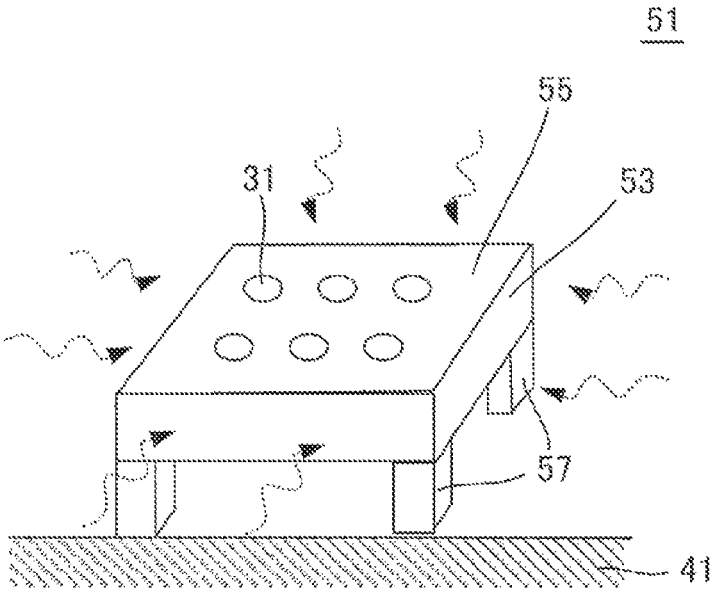
FIG. 7 is a perspective view of a shelf according to one embodiment of a heating jig of the present invention.

FIG. 7 is a perspective view of a shelf 51 which is one embodiment of the heating jig of the present invention. The shelf 51 shown in this diagram includes a shelf plate 53, and one of two front and back surfaces of the shelf plate 53 is a mounting face 55 on which articles 31 to be heated can be mounted. Moreover, the shelf plate 53 is stacked on supporters 57 disposed on a floor 41, and hence the shelf plate 53 is stacked away from the floor 14. At this time, the supporters 57 are attached to the surface of the surface of the shelf plate 53 opposite to the mounting face 55.

Figure 8:
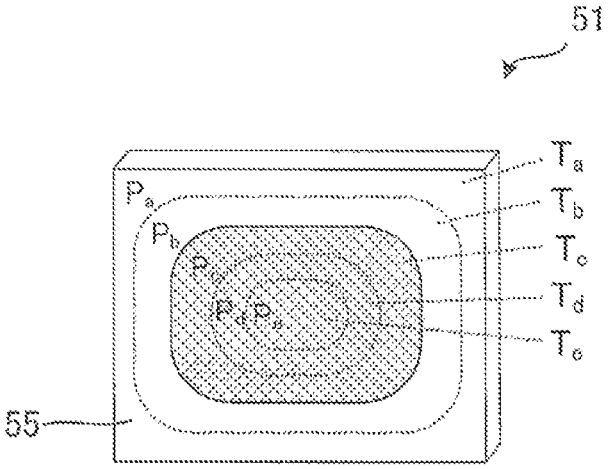
FIG. 8 is a diagram for explaining the thermal emissivity of the mounting face of the shelf shown in FIG. 7.

FIG. 8 is a diagram for explaining the thermal emissivity of the mounting face 55 of the shelf 51 shown in FIG. 7. When the shelf 51 shown in FIG. 7 is stored in a furnace to heat the articles to be heated by radiant heat transfer from a furnace wall, heat is transferred from an edge side portion of the shelf plate 53 to the center portion thereof in order of regions $P_a$, $P_b$, $P_c$, $P_d$, and $P_e$. Therefore, during initial heating, surface temperatures $T_a$ to $T_e$ of the regions $P_a$ to $P_e$ of the mounting face 55 of the shelf plate 53 have a relation of $T_a>T_b>T_c>T_d>T_e$. When the amounts of heat received by the articles 31 to be heated by the radiant heat transfer from the furnace wall are similarly arranged in order from the largest heat amount in the above distribution of the surface temperature of the mounting face 55, the articles mounted on the regions $P_a$, $P_b$, $P_c$, $P_d$, and $P_e$ have this order of the heat amounts. In the shelf 51, the thermal emissivity of the regions $P_c$ to $P_e$ of the mounting face 55 (a dot pattern in FIG. 8) is larger than that of the regions $P_a$ and $P_b$. Therefore, when the articles 31 to be heated are mounted on the regions $P_c$, to $P_e$ of the mounting face 55, the articles receive a large amount of heat by the radiant heat transfer from the mounting face 55. When the articles are mounted on the regions $P_a$ and $P_b$ of the mounting face 55, the articles receive a small amount of heat by the radiant heat transfer from the mounting face 55. Therefore, a difference in the total amount of the heat received by the radiant heat transfer from the furnace wall and the heat received by the radiant heat transfer from the mounting face 55 becomes small among the articles 31 mounted on the regions $P_a$ to $P_e$.

Figure 9:
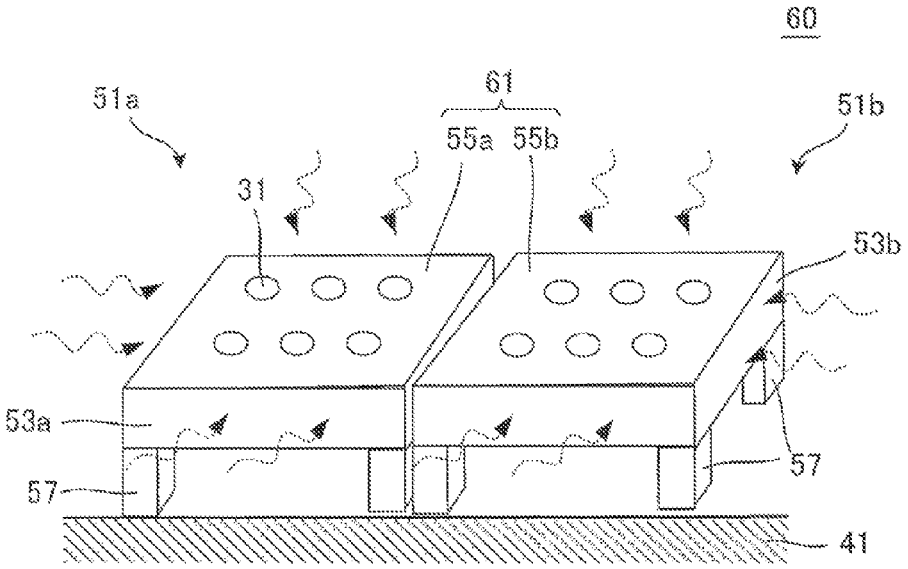
FIG. 9 is a perspective view of a shelf assembly according to the embodiment of the heating jig of the present invention.

FIG. 9 is a perspective view of a shelf assembly 60 which is one embodiment of the heating jig of the present invention. The shelf assembly 60 is obtained by transversely arranging and assembling two shelves 51*a* and 51*b*. In the shelves 51*a* and 51*b*, shelf plates 53*a* and 53*b* are supported by the floor 41 via supporters 57 having an equal height, whereby a mounting face 55*a* of the shelf plate 53*a* and a mounting face 55*b* of the shelf plate 53*b* are arranged on substantially the same plane. Therefore, when the shelves 51*a* and 51*b* are assembled to prepare the shelf assembly 60, the shelf assembly 60 can be provided with one mounting face 61 obtained by combining the mounting faces 55*a* and 55*b*.

Figure 10:
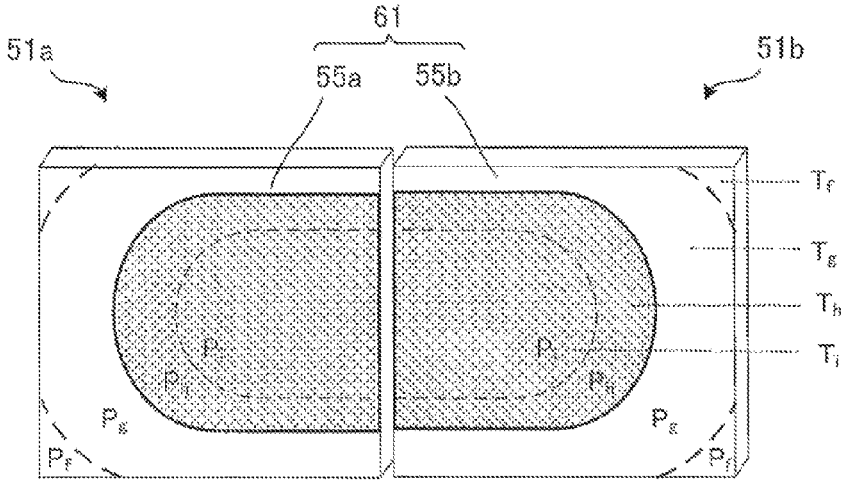
FIG. 10 is a diagram for explaining the thermal emissivity of the mounting surface of the shelf assembly shown in FIG. 9.

FIG. 10 is a diagram for explaining the thermal emissivity of the mounting face 61 of the shelf assembly 60 shown in FIG. 9. When the shelf assembly 60 shown in FIG. 9 is stored in a furnace to heat the shelf assembly 60 together with articles 31 to be heated by radiant heat transfer from a furnace wall, heat is transferred from an edge side portion of the shelf assembly 60 to the center portion thereof in order of regions $P_f$, $P_g$, $P_h$, and $P_i$. Therefore, during initial heating, surface temperatures $T_f$ to $T_i$ of the regions $P_f$ to $P_i$ of the mounting face 61 of the shelf assembly 60 have a relation of $T_f>T_g>T_h>T_i$. It is to be noted that edge sides of the shelves 51*a* and 51*b* where the shelf 51*a* comes close to the shelf 51*b* correspond to the center portion of the shelf assembly 60, and hence the radiant heat transferred from the furnace wall is not easily received. Therefore, in the shelf assembly 60, the thermal emissivity of the regions $P_h$ and $P_i$ of the mounting face 61 (a dot pattern in FIG. 10) is set to be larger than that of the regions $P_f$ and $P_g$. In this case, owing to an action similar to that of the shelf 51 described above with reference to FIG. 7, a difference in the total amount of the heat received by the radiant heat transfer from the furnace wall and the heat received by the radiant heat transfer from the mounting face 55 becomes small among the articles 31 mounted on the regions $P_f$ to $P_i$.

4. Operation Method of Heating Device:

In a heating step, when a temperature difference is generated in the articles to be heated, a heat stress is generated in the articles to be heated. When this heat stress exceeds a material strength, thermal shock cracks and the like are generated. To cope with this problem, in a conventional heating step, an ambient temperature in a space where the articles to be heated are disposed is moderately raised so that a temperature difference in the articles to be heated is not enlarged. In this case, defects such as the thermal shock cracks are not easily generated in the articles to be heated (e.g., refer to JP-A-2003-212672 and JP-A-2004-059357). However, in a method of moderately raising the ambient temperature in the space where the articles to be heated are disposed, a problem occurs that time required for the temperature rise lengthens and much energy is consumed for the temperature rise. To solve this problem, the present inventors set up a purpose of providing an operation method of a heating device having a low generation frequency of damages by the heating of the articles to be heated and having a high energy efficiency. The present inventors have contrived the operation of the heating device as follows.

The operation method of the present heating device (hereinafter referred to as "the present operation method") is characterized by using the heating device comprising a storage section which contains articles to be heated in a storage chamber surrounded by a wall part having an inner wall surface made of a material having a thermal emissivity of 0.7 or more at a wavelength of 1.6 to 2.6 μm, ambient temperature measuring means for measuring an ambient temperature in the storage chamber, temperature distribution measurement means for measuring a temperature distribution in the article to be heated, and heating means for heating the inside of the storage chamber while controlling a temperature rise speed of the ambient temperature based on the ambient temperature measured by the ambient temperature measuring means and the temperature distribution measured by the temperature distribution measuring means.

Furthermore, the present operation method is characterized by storing the articles to be heated in the storage chamber of the storage section; and heating the inside of the storage chamber by the heating means while controlling the temperature rise speed of the ambient temperature so that the temperature distribution in the article to be heated measured by the temperature distribution measuring means is from 0.9 to 1.0 time a maximum allowable value, when the ambient temperature measuring means measures the ambient temperature having the maximum allowable value of the temperature distribution in the article to be heated, which is determined so that any defect is not generated in the articles to be heated.

In the operation method of the present heating device, the articles to be heated are heated in the storage chamber surrounded by the inner wall surface made of a material having a high thermal emissivity to easily obtain a uniform temperature in the articles to be heated. The temperature rise speed of the ambient temperature in the storage chamber is raised as much as possible. Therefore, the energy efficiency required for the temperature rise can be increased, and the generation of a defective article to be heated can be minimized.

Since the inner wall surface of the wall part surrounding the storage chamber is made of the material having a thermal emissivity of 0.7 or more at a wavelength of 1.6 to 2.6 μm, the articles disposed in the storage chamber can receive much more heat by the radiant heat transfer from the wall part around the articles. Therefore, the articles to be heated can be heated while the width of the temperature distribution is set to be smaller.

Figure 20:
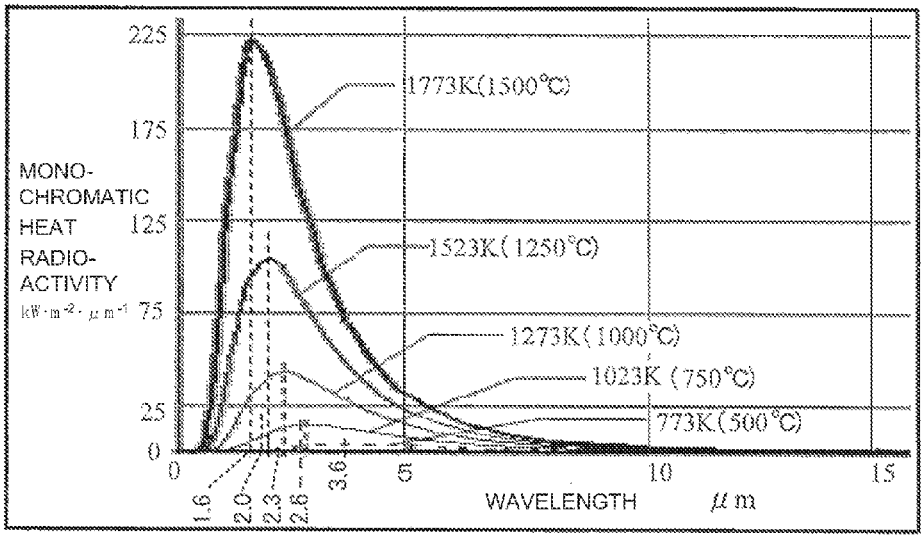
FIG. 20 is a diagram showing a radiation wavelength distribution of a black body.

FIG. 20 shows a radiation wavelength distribution of a black body. Among electromagnetic waves radiated from a black body at 750 to 1500° C., a wavelength at which radiant intensity becomes maximum is from 1.6 to 2.6 μm. Therefore, in radiant heat transfer in the storage chamber, when the ambient temperature in the storage chamber is from 750 to 1500° C., a thermal emissivity at a wavelength of 1.6 to 2.6 μm becomes dominant.

Figure 21:
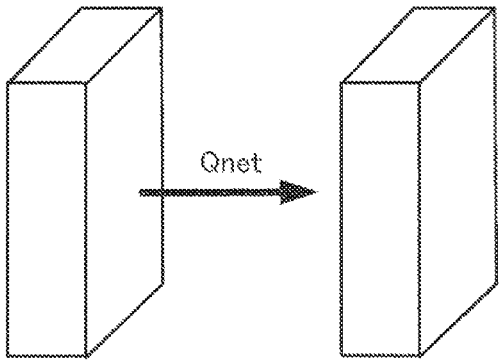
FIG. 21 is a diagram for explaining radiant heat transfer amount from a wall part of a flat plate to a flat plate to be heated.

A radiant heat transfer amount from a wall part of a flat plate (temperature $T_1$ and thermal emissivity $e_1$) to a flat plate to be heated (temperature $T_2$ and thermal emissivity $e_2$) shown in FIG. 21 is represented by the following equation (I).

[Equation I] Equation 1

$$Qnet = Q_1 - Q_2 = \frac{1}{\frac{1}{e_1} + \frac{1}{e_2} - 1} \times (\sigma T_2^4 - \sigma T_1^4)$$

$$\sigma = (2 \cdot \pi^5 \cdot k^4)/(15 \cdot h^3 \cdot C^2)$$
$$= 5.67 \times 10^{-8} (\mathrm{W/m^2 \cdot K^4})$$

Figure 22:
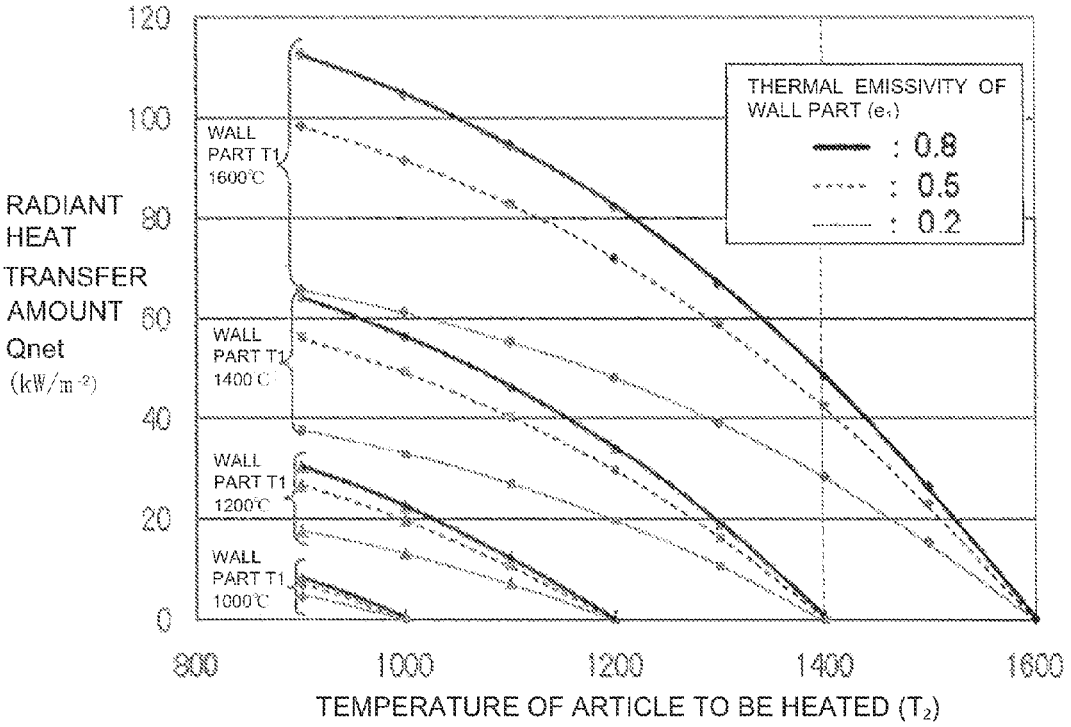
FIG. 22 is a diagram showing results of calculation of the radiant heat transfer amount from the wall part of the flat plate to the flat plate to be heated shown in FIG. 21.

FIG. 22 shows results of calculation of radiant heat transfer amount Qnet received by the flat plate to be heated (the temperature $T_2$=900 to 1600° C. and the thermal emissivity $e_2$=0.2) from the wall part of the flat plate (the temperature $T_2$=900 to 1600° C. and the thermal emissivity $e_2$=0.2/0.5/0.8) on the basis of the equation (I). Even when the temperature $T_1$ of the wall part of the flat plate is 1000° C., 1200° C., 1400° C., or 1600° C., the radiant heat transfer amount Qnet increases as the thermal emissivity of the wall part of the flat plate increases. For example, when the temperature $T_1$ of the wall part of the flat plate is 1600° C. and the temperature $T_2$ of the flat plate to be heated is 1400° C., the radiant heat transfer amount Qnet increases as the thermal emissivity $e_1$ of the wall part of the flat plate increases to 0.2, 0.5, or 0.8.

As understandable from the above finding described with reference to FIGS. 20 to 22, in the heating device for use in the present operation method, since the inner wall surface of the wall part surrounding the storage chamber is made of the material having a thermal emissivity of 0.7 or more at a wavelength of 1.6 to 2.6 μm, heat accumulated in the wall part by the radiant heat transfer can efficiently be transferred to the articles to be heated.

There is not any special restriction on the specific constitution of the ambient temperature measuring means as long as the means can measure the ambient temperature in the storage chamber in real time.

The temperature distribution measuring means measures the temperature distribution in the article to be heated in real time. The temperature distribution in the article mentioned in the present description is measured so that defects such as damages or surface color unevenness due to heat stress are not generated, and the temperature distribution does not necessarily mean a difference between the maximum temperature and the minimum temperature in the articles to be heated. The temperature distribution measuring means does not necessarily have to measure the temperatures of all portions in the articles to be heated. For example, when the difference in the surface temperature between two specific places A and B in the article to be heated is measured, the generation of the damages on the article to be heated can be prevented. In this case, the temperature distribution measuring means measures the surface temperature difference between the specific place A and the specific place B in the article to be heated. Even when there is a place having a temperature higher or lower than the temperature of the place A or B in the article to be heated, the surface temperature difference between the place A and the place B may be regarded as the temperature distribution.

In the articles to be heated, the maximum allowable value of the temperature distribution in the article to be heated is determined so that defects such as the damages or the surface color unevenness due to the heat stress are not generated in the articles to be heated. The maximum allowable value is determined in accordance with the ambient temperature in the storage chamber. For example, in the operation method of the heating device for raising the ambient temperature in the storage chamber from 20° C. to 1200° C., when the temperature distribution in the article to be heated at the ambient temperature of 1000 to 1200° C. exceeds 1% of the ambient temperature (e.g., 10° C. at 1000° C. or 12° C. at 1200° C.), a defective article to be heated is generated. In this case, the maximum allowable value of the temperature distribution in the article to be heated is set to 10° C. at the ambient temperature of 1000° C. or 12° C. at the ambient temperature of 1200° C. It is to be noted that the maximum allowable value of the temperature distribution in the article to be heated varies in accordance with the size, shape, material or the like of the articles to be heated. For example, the maximum allowable value of the temperature distribution in the article to be heated can be determined based on preliminary experiments or empirical findings.

When the temperature rise speed of the ambient temperature in the storage chamber is higher, the width of the temperature distribution in the article to be heated further easily enlarges. In the present operation method, since the heating means controls the temperature rise speed of the ambient temperature in the articles to be heated so that the temperature distribution in the article to be heated is from 0.9 to 1.0 time the above maximum allowable value, the temperature rise speed of the ambient temperature in the storage chamber does not lower excessively. Furthermore, this temperature rise speed is raised to such an extent that the width of the temperature distribution in the article to be heated is not enlarged excessively. Therefore, the articles to be heated can rapidly be heated so that any defect is not generated in the articles to be heated. Especially in the present operation method, the articles to be heated in the storage chamber can receive a large amount of heat owing to radiant heat transfer from the wall part, and hence the width of the temperature distribution in the article to be heated tends to become small. In such a situation where the width of the temperature distribution becomes small, the temperature rise speed of the ambient temperature in the storage chamber has to be raised so that the temperature distribution in the article to be heated is from 0.9 to 1.0 time the above maximum allowable value. Therefore, in the present operation method, since the temperature rise speed of the ambient temperature is increased, time required for raising the ambient temperature to a desirable temperature can be shortened, so that energy required for raising the ambient temperature can be decreased.

In the present operation method, the material of the inner wall surface is regulated so that the thermal emissivity of the material is 0.7 or more at a wavelength of 1.6 to 2.6 μm. When it is considered that the wavelength of 1.6 to 2.6 μm is dominant in heat radiation at 750 to 1500° C., the ambient temperature in the storage chamber is preferably raised to be 750° C. or higher in the present operation method. When the temperature of the inner wall surface is from 750 to 1500° C., much heat is transferred from the wall part to the articles to be heated by radiant heat transfer, and the temperature distribution in the article to be heated further easily becomes uniform. Therefore, the temperature rise speed of the ambient temperature in the storage chamber has to be further increased so that the temperature distribution in the article to be heated is from 0.9 to 1.0 time the maximum allowable value, when the ambient temperature in the storage chamber is from 750 to 1500° C. Therefore, time required for temperature rise in an ambient temperature range from 750 to 1500° C. is further shortened.

In the present operation method, the inner wall surface of the wall part of the storage section is preferably made of a material including at least two components selected from the group consisting of silicon carbide (SiC), titanium oxide ($TiO_2$, TiO or the like), and silica ($SiO_2$) (cristobalite, tridymite, silica or the like). Since the emissivity of this material at a wavelength of 1.6 to 2.6 μm is 0.7 or more at both ordinary temperature (25° C.) and high temperature, the above material can be selected to increase the efficiency of radiant heat transfer. In consequence, when the temperature distribution enlarges in the articles to be heated, the efficiency of the heat transfer to a low temperature portion of the article to be heated is kept to be high as compared with the heat transfer to a high temperature portion of the article to be heated. In consequence, the width of the temperature distribution in the article to be heated can be reduced.

The wall part of the heating device includes an inner wall member forming the inner wall surface, and a supporter with which the inner wall member is lined, and the inner wall member has a thickness of 0.1 to 3.0 mm and is made of a material containing at least two components selected from the group consisting of silicon carbide (SiC), titanium oxide ($TiO_2$ or TiO) and silica ($SiO_2$) (cristobalite, tridymite, or silica glass). The above inner wall member can transfer much heat to the articles to be heated by the radiant heat transfer, when the temperature of the inner wall member is from 750 to 1500° C. Moreover, since the inner wall member has a thickness of 3.0 mm or less, a heat capacity lowers, and it is possible to decrease the absolute value of the heat amount necessary for transferring the heat to the articles to be heated by the radiant heat transfer.

In the present operation method, when the width of the temperature distribution in the article to be heated does not easily enlarge, the temperature rise speed of the ambient temperature in the storage chamber can further be increased. In consequence, the efficiency of the energy can further be improved. When the plurality of articles to be heated are simultaneously heated by using the above housing for heating and heating jig of the present invention, the difference in the amount of the heat received by the articles to be heated can be decreased. Moreover, the width of the temperature distribution in each article to be heated does not easily enlarge. Therefore, in the present operation method, the above housing for heating and heating jig of the present invention are preferably used. In the present operation method, when the housing for heating and heating jig of the present invention are used, the temperature rise speed of the ambient temperature in the storage chamber can further be increased. In consequence, the generation frequency of damages due to the heating of the articles to be heated can further be decreased, and the efficiency of the energy can further be improved.

EXAMPLES

Hereinafter, the present invention will be described with respect to examples in more detail, but the present invention is not limited to these examples.

(1) Shelf Assembly

Figure 11:
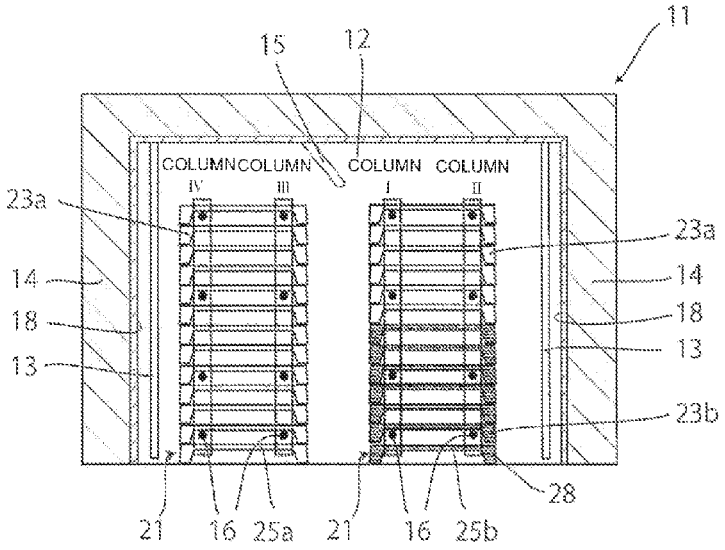
FIG. 11 is an exemplary diagram of an electric furnace in which shelf assemblies of Example 1 and Comparative Example 1 are stored.

FIG. 11 shows a front view of shelf assemblies 21 stored in a furnace inner space 12 of an electric furnace 11. A plurality of shelves 23*a* (white shelves in FIG. 11) made of an alumina material were prepared by disposing legs 28 (a height of 20 mm) at four corners of the lower surface of each quadrangular (width 200×length 300 mm) shelf plate 25*a*. Furthermore, a plurality of shelves 23*b* (dot patterns in FIG. 11) were prepared by disposing a coat layer having a thickness of 170 μm on the whole surface of each shelf 23*a* (each of the shelves 23*b* included a shelf plate 25*b* obtained by disposing a coat layer on the surface of the shelf plate 25*a*). Each coat layer was disposed by applying a mixed slurry to the surface of the shelf 23*a* by spray coating. This mixed slurry was prepared by mixing a mixture of titanium oxide and $SiO_2$ (TiO=50 mass % and $SiO_2$=50 mass %) with 3 mass % of water glass, 40 mass % of water and 3 mass % of organic binder of polyvinyl pyrrolidone (PVP) by external blending.

(2) Electric Furnace

The electric furnace 11 had an effective inner dimension of width 500×depth 500×height 500 mm, and heaters 13 were installed on wall surfaces 18 of all furnace walls 14 on all four surfaces constituting side surfaces (FIG. 11). A furnace temperature control thermocouple 15 was disposed in the center of the furnace wall 14 on a ceiling side.

(3) Heating Test:

Shelf assemblies 21 of Example 1 and Comparative Example 1 described hereinafter were arranged in the furnace inner space 12 of the electric furnace 11 as shown in FIG. 11, and a heating test was performed.

Example 1

Shelves 23*a* which were not provided any coat layer were stacked as six upper stages, and shelves 23*b* provided with coat layers were stacked as seven lower stages, to assemble a shelf assembly 21 having 13 stages in total. The shelf assembly 21 was disposed on the right side in the furnace inner space 12 as one faced a door of the electric furnace 11 (on the right side in FIG. 11). It is to be noted that a pair of thermocouples 16 (eight thermocouples in total) were installed on the backside of each of the shelf plates 25*a* and 25*b* of the shelves 23*a* and 23*b* in the second, fifth, ninth and thirteenth stages of the shelf assembly 21. The thermocouples 16 were installed as a pair of right and left thermocouples (in columns I and II in FIG. 11) as one faced the door of the furnace 11.

Comparative Example 1

Shelves 23*a* which were not provided with any coat layer were stacked in 13 stages to assemble a shelf assembly 21. The shelf assembly 21 was disposed on the left side of a furnace inner space 12 as one faces a door of an electric furnace 11 (on the left side in FIG. 11). Thermocouples 16 were installed in the same manner as in Example 1 (columns III and IV in FIG. 11).

Figure 12:
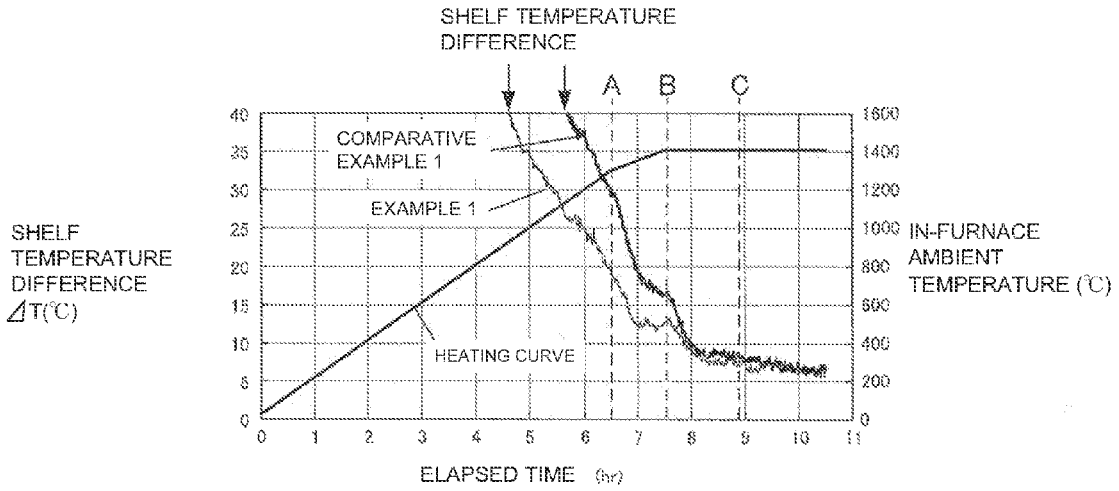
FIG. 12 is a graph showing a heating curve of an in-furnace ambient temperature in the electric furnace shown in FIG. 11, and a difference between a temperature in the shelf assembly of Example 1 and that of Comparative Example 1.
Figure 13:
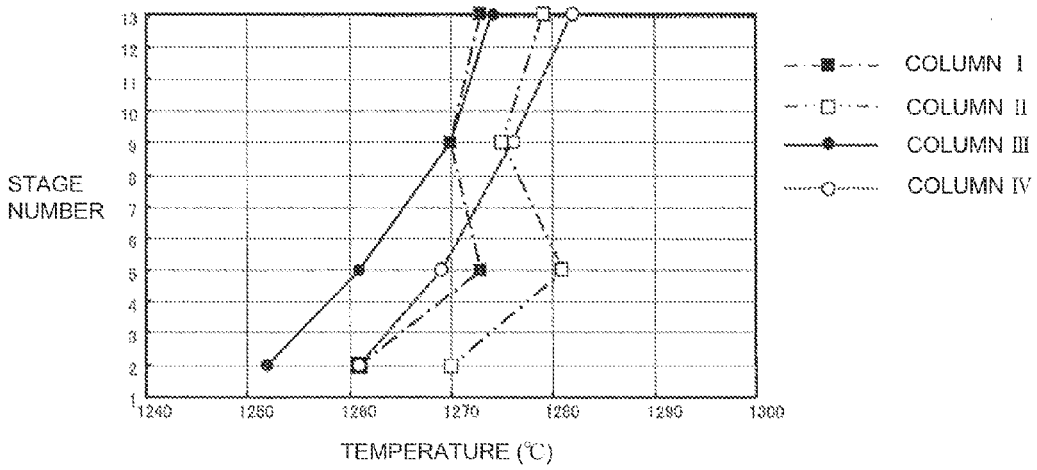
FIG. 13 is a graph showing a temperature in each place of the shelf assemblies of Example 1 and Comparative Example 1 at time A shown in FIG. 12.
Figure 14:
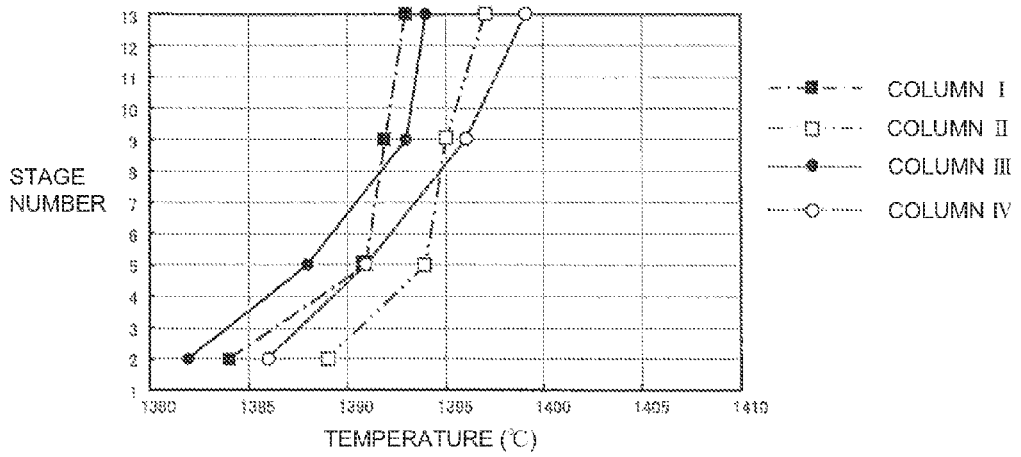
FIG. 14 is a graph showing the temperature in each place of the shelf assemblies of Example 1 and Comparative Example 1 at time B shown in FIG. 12.
Figure 15:
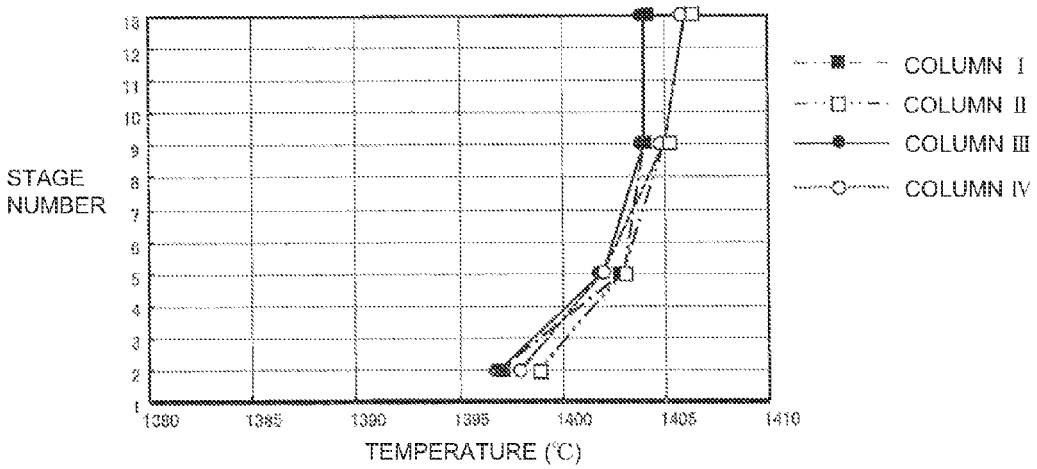
FIG. 15 is a graph showing the temperature in each place of the shelf assemblies of Example 1 and Comparative Example 1 at time C shown in FIG. 12.

In the electric furnace 11, the shelf assemblies 21 of Example 1 and Comparative Example 1 were disposed, and an ambient temperature in the furnace inner space 12 was raised as shown by a heating curve in FIG. 12 until the ambient temperature in the furnace inner space 12 reached 1400° C. Afterward, this ambient temperature was held. Specifically, the temperature was raised from 25° C. to 1300° C. by heating for 6.5 hours. Subsequently, the temperature was raised from 1300° C. to 1400° C. by heating for one hour. Afterward, the temperature was held at 1400° C. for 3.0 hours. The surface temperatures of the shelf plates 25*a* and 25*b* measured by the thermocouples 16 installed in the shelf assemblies 21 of Example 1 and Comparative Example 1 in 6.5 hours (elapsed time shown at A of FIG. 12), 7.5 hours (elapsed time shown at B of FIG. 12) and 8.9 hours (elapsed time shown at C of FIG. 12) after start of heating are shown in graphs of FIGS. 13, 14, and 15, respectively. In the graphs of FIGS. 13 to 15, the abscissa shows the surface temperatures of the shelf plates 25*a* and 25*b* measured by the thermocouples 16, and the ordinate shows the stage numbers of the shelves 23*a* and 23*b* in the shelf assembly 21. A difference (ΔT) between the maximum temperature and the minimum temperature among the surface temperatures of the shelf plates 25*a* and 25*b* measured by eight thermocouples 16 installed in the shelf assembly 21 is shown in FIG. 12. It is seen from the graph concerning the temperature difference in the shelf assembly shown in FIG. 12 that in Example 1, the difference (ΔT) between the maximum temperature and the minimum temperature in the shelf assembly 21 becomes small as compared with Comparative Example 1.

From a positional relation between the furnace walls 14 and the heaters 13, column I of Example 1 exhibits a contrast to column III of Comparative Example 1, and column II of Example 1 exhibits a contrast to column IV of Comparative Example 1. Hereinafter, results of comparison of the columns in contrast to each other will be described.

Here, the results in 6.5 hours after the start of the heating shown in FIG. 13 will be described. First, Comparative Example 1 (the columns III and IV) had a tendency that the temperature of the upper stages (the ninth and thirteenth stages) was higher than that of the lower stages (the second and fifth stages). It is considered that this tendency occurred when a warmed in-furnace gas flows upwards. In the column III of Comparative Example 1, the temperature gradually rose from the second stage to the thirteenth stage, and the maximum value of temperature differences among the second, fifth, ninth and thirteenth stages was 22° C. (the temperature difference between the second stage and the thirteenth stage). Also in the column IV of Comparative Example 1, the temperature gradually rose from the second stage to the thirteenth stage, and the maximum value of the temperature differences among the second, fifth, ninth and thirteenth stages was 21° C. (the temperature difference between the second stage and the thirteenth stage).

In 6.5 hours after the start of the heating shown in FIG. 13, the stage in the column I of Example 1 was compared with the same stage in the column III of Comparative Example 1. In this case, the temperature of the second stage was 9° C. higher, and the temperature of the fifth stage was 11° C. higher. Conversely, the temperature of the thirteenth stage was 1° C. lower. In the column I of Example 1, the maximum value of the temperature differences among the second, fifth, ninth and thirteenth stages was 12° C. (the temperature difference between the second stage and the fifth stage and between the second stage and the thirteenth stage), and the value was significantly smaller than the maximum value of 22° C. (the temperature difference between the second stage and the thirteenth stage) of the temperature differences in the column III of Comparative Example 1. In particular, when the comparison was limited to the fifth, ninth and thirteenth stages, the maximum value of the temperature differences in the column III of Comparative Example 1 was 13° C. (the temperature difference between the fifth stage and the thirteenth stage), whereas the maximum value of the temperature differences in the column I of Example 1 was a remarkably significantly small value of 3° C. (the temperature difference between the fifth stage and the ninth stage and between the ninth stage and the thirteenth stage). Similarly, when the column II of Example 1 was compared with the column IV of Comparative Example 1, i.e., the stage in the column II of Example 1 was compared with the same stage in the column IV of Comparative Example 1, the temperature of the second stage was 9° C. higher, and the temperature of the fifth stage was 12° C. higher. Conversely, the temperature of the thirteenth stage was 3° C. lower. In the column II of Example 1, the maximum value of the temperature differences among the second, fifth, ninth and thirteenth stages was 9° C. (the temperature difference between the second stage and the thirteenth stage), and the value was significantly smaller than the maximum value of 21° C. (the temperature difference between the second stage and the thirteenth stage) of the temperature differences in the column IV of Comparative Example 1. In particular, when the comparison was limited to the fifth, ninth and thirteenth stages, the maximum value of the temperature differences in the column IV of Comparative Example 1 was 13° C. (the temperature difference between the fifth stage and the thirteenth stage), whereas the maximum value of the temperature differences in the column II of Example 1 was a remarkably significantly small value of 6° C. (the temperature difference between the fifth stage and the ninth stage).

Next, the results in 7.5 hours after the start of the heating shown in FIG. 14 will be described. In the column III of Comparative Example 1, the temperature gradually rose from the second stage to the thirteenth stage, and the maximum value of the temperature differences among the second, fifth, ninth and thirteenth stages was 12° C. (the temperature difference between the second stage and the thirteenth stage). Also in the column IV of Comparative Example 1, the temperature gradually rose from the second stage to the thirteenth stage, and the maximum value of the temperature differences among the second, fifth, ninth and thirteenth stages was 13° C. (the temperature difference between the second stage and the thirteenth stage).

In 7.5 hours after the start of the heating shown in FIG. 14, the stage in the column I of Example 1 was compared with the same stage in the column III of Comparative Example 1. In this case, the temperature of the second stage was 2° C. higher, and the temperature of the fifth stage was 3° C. higher. Conversely, the temperature of the thirteenth stage was 1° C. lower. In the column I of Example 1, the maximum value of the temperature differences among the second, fifth, ninth and thirteenth stages was 9° C. (the temperature difference between the second stage and the thirteenth stage), and the value was significantly smaller than the maximum value of 12° C. (the temperature difference between the second stage and the thirteenth stage) of the temperature differences in the column III of Comparative Example 1. In particular, when the comparison was limited to the fifth, ninth and thirteenth stages, the maximum value of the temperature differences in the column III of Comparative Example 1 was 6° C. (the temperature difference between the fifth stage and the thirteenth stage), whereas the maximum value of the temperature differences in the column I of Example 1 was a remarkably significantly small value of 2° C. (the temperature difference between the fifth stage and the thirteenth stage). Similarly, when the column II of Example 1 was compared with the column IV of Comparative Example 1, i.e., the stage in the column II of Example 1 was compared with the same stage in the column IV of Comparative Example 1, the temperature of the second stage was 3° C. higher, and the temperature of the fifth stage was 3° C. higher. Conversely, the temperature of the ninth stage was 1° C. lower, and the temperature of the thirteenth stage was 2° C. lower. In the column II of Example 1, the maximum value of the temperature differences among the second, fifth, ninth and thirteenth stages was 8° C. (the temperature difference between the second stage and the thirteenth stage), and the value was significantly smaller than the maximum value of 13° C. (the temperature difference between the second stage and the thirteenth stage) of the temperature differences in the column IV of Comparative Example 1. In particular, when the comparison was limited to the fifth, ninth and thirteenth stages, the maximum value of the temperature differences in the column IV of Comparative Example 1 was 8° C. (the temperature difference between the fifth stage and the thirteenth stage), whereas the maximum value of the temperature differences in the column II of Example 1 was a remarkably significantly small value of 3° C. (the temperature difference between the fifth stage and the thirteenth stage).

Finally, results in 8.9 hours after the start of the heating shown in FIG. 15 will be described. The temperature in 8.9 hours after the start of the heating had a stationary state where the in-furnace temperature was held at 1400° C. Therefore, a large difference was not recognized in the temperature between Example 1 (the columns I and II) and Comparative Example 1 (the columns III and IV). This is because heat transfer in the temperature stationary state was balanced with the sum of the heat amounts of reflection and radiation. This can be explained according to Boltzmann rule where the sum of emissivity and reflectivity is 1.

Figure 16:
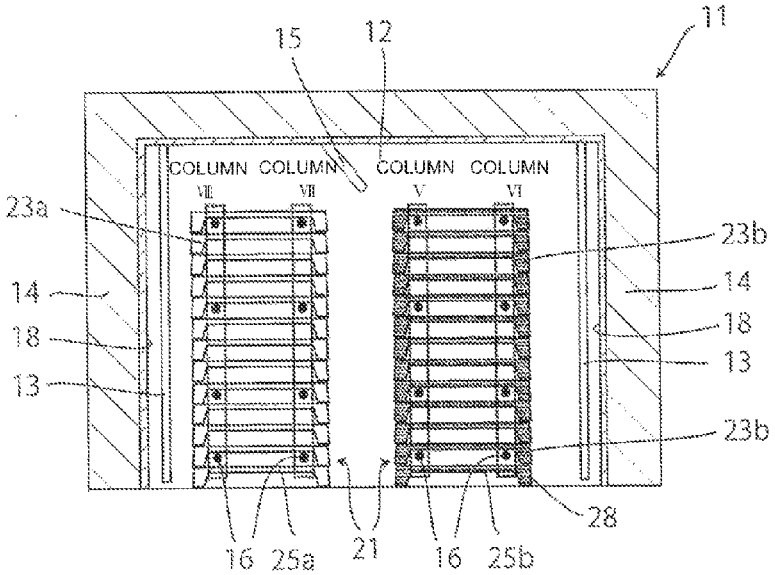
FIG. 16 is an exemplary diagram of an electric furnace in which shelf assemblies of Comparative Examples 2 and 3 are stored.

Shelf assemblies 21 of Comparative Examples 2 and 3 described hereinafter were arranged in a furnace inner space 12 of an electric furnace 11 as shown in FIG. 16, and a heating test was performed.

Comparative Example 2

Shelves 23*b* provided with coat layers were stacked in 13 stages to assemble a shelf assembly 21. The shelf assembly 21 was disposed on the right side in a furnace inner space 12 as one faced a door of an electric furnace 11 (on the right side in FIG. 16). Places where thermocouples 16 were installed were the same as those in Example 1 (columns V and VI in FIG. 16).

Comparative Example 3

Shelves 23*a* which were not provided with any coat layer were stacked in 13 stages to assemble a shelf assembly 21. The shelf assembly 21 was disposed on the left side in a furnace inner space 12 as one faced a door of an electric furnace 11 (on the left side in FIG. 16). Places where thermocouples 16 were installed were the same as those in Example 1 (columns VII and VIII in FIG. 16).

Figure 17:
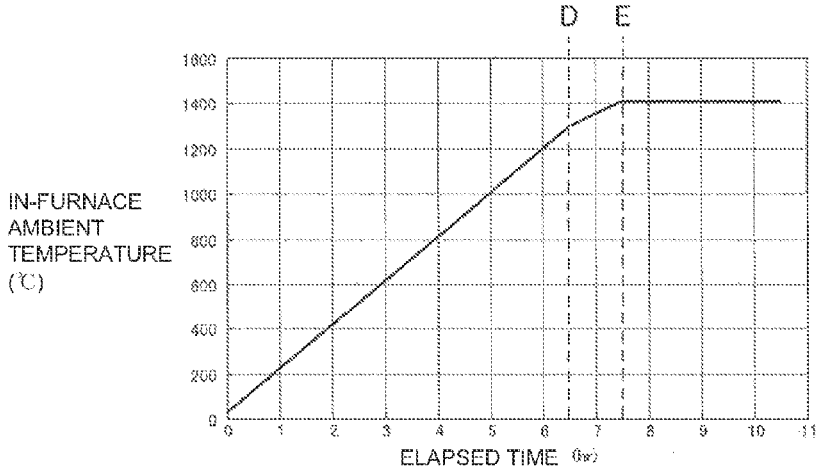
FIG. 17 is a graph showing a heating curve of an in-furnace ambient temperature in the electric furnace shown in FIG. 16.
Figure 18:
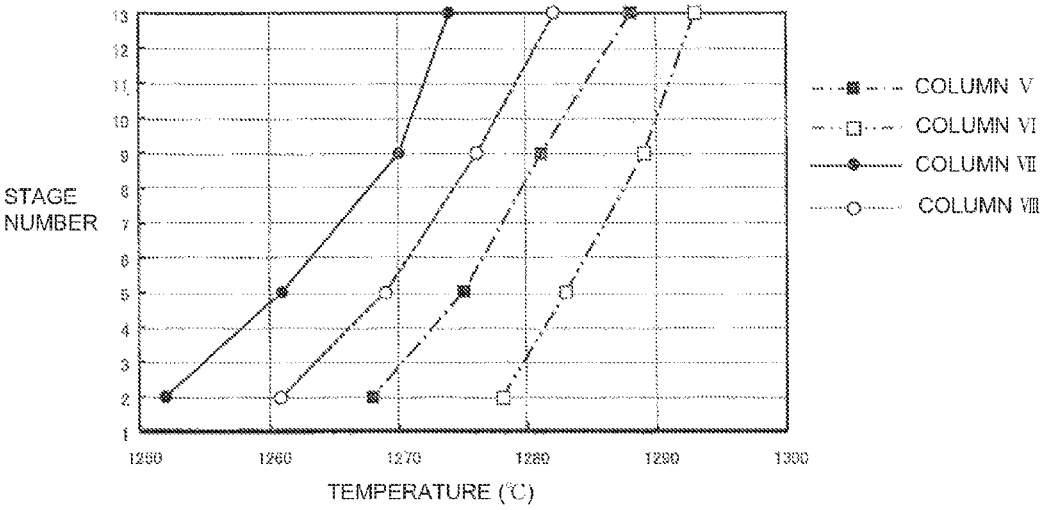
FIG. 18 is a graph showing a temperature in each place of the shelf assemblies of Comparative Examples 2 and 3 at time D shown in FIG. 17.
Figure 19:
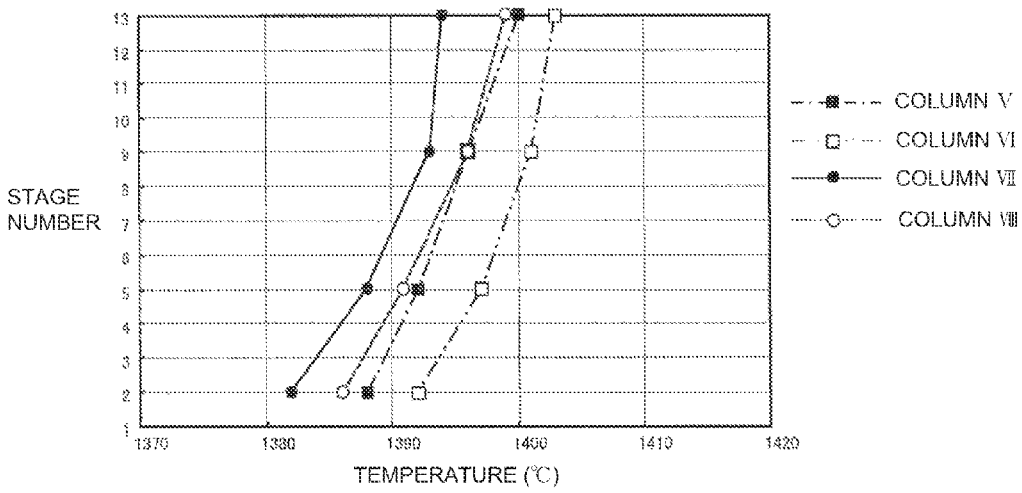
FIG. 19 is a graph showing a temperature in each place of the shelf assemblies of Comparative Examples 2 and 3 at time E shown in FIG. 17.

In the electric furnace 11, the shelf assemblies 21 of Comparative Examples 2 and 3 were disposed, and an ambient temperature in the furnace inner space 12 was raised as shown by a heat curve shown in FIG. 17 until the ambient temperature in the furnace inner space 12 reached 1400° C. Afterward, this ambient temperature was held. Specifically, the temperature was raised from 25° C. to 1300° C. by heating for 6.5 hours. Subsequently, the temperature was raised from 1300° C. to 1400° C. by heating for one hour. Afterward, the temperature was held at 1400° C. for 3.0 hours. The heating was performed on the above conditions. The surface temperatures of shelf plates 25*a* and 25*b* measured by the thermocouples 16 installed in the shelf assemblies 21 of Comparative Examples 2 and 3 in 6.5 hours (elapsed time shown at D of FIG. 17) and 7.5 hours (elapsed time shown at E of FIG. 17) after the start of the heating are shown in graphs of FIGS. 18 and 19, respectively. In the graphs of FIGS. 18 and 19, the abscissa shows the surface temperatures of the shelf plates 25*a* and 25*b* measured by the thermocouples 16, and the ordinate shows the stage numbers of the shelves 23*a* and 23*b* in the shelf assembly 21.

In either of 6.5 hours and 7.5 hours after the start of the heating, the temperature of the shelf assembly was higher in Comparative Example 2 owing to a large thermal emissivity of the shelves as compared with Comparative Example 3. However, a temperature distribution in the shelf assembly was substantially the same in Comparative Examples 2 and 3, and unlike Example 1, an effect of obtaining a small temperature distribution was not observed. Therefore, it has been found that even when the thermal emissivities of all the shelves are uniformly set to be large, the effect of obtaining the small temperature distribution in the shelf assembly is not produced.

Next, investigations of the above-mentioned operation method of the heating device will be described. Reference Example 1 described hereinafter belongs to the technical range of the operation method of the heating device (the present operation method). On the other hand, Reference Examples 2 and 3 do not belong to the technical range of the present operation method.

Reference Example 1

(1) Electric Furnace

Figure 23:
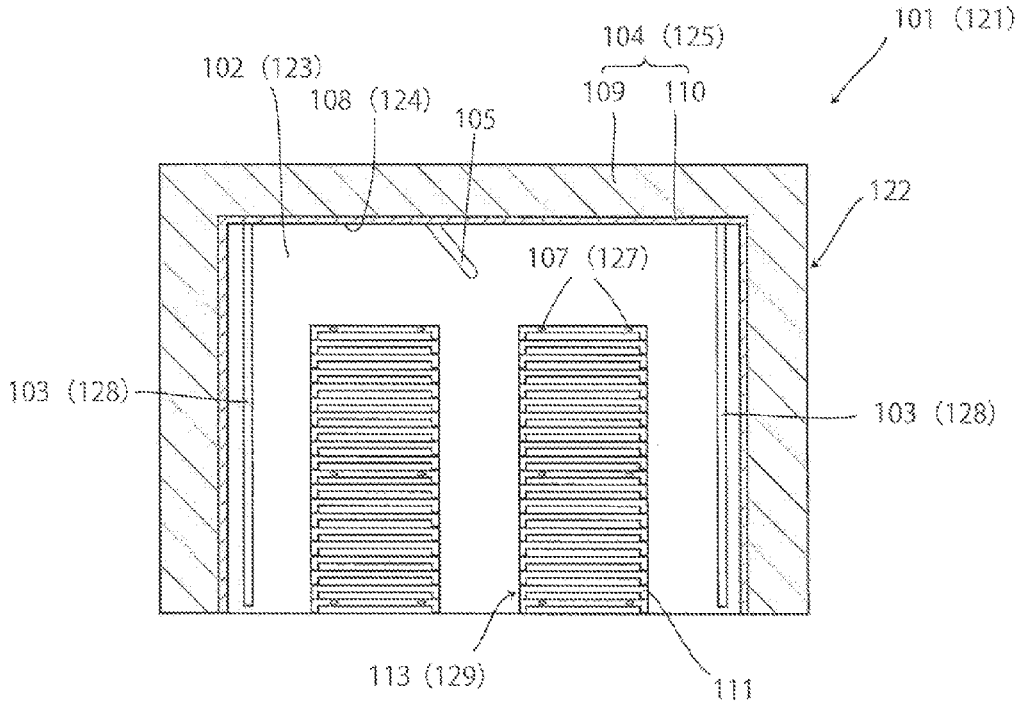
FIG. 23 is an exemplary diagram of an electric furnace used in Reference Example 1.

FIG. 23 shows an electric furnace 101 used in Reference Example 1. As a furnace wall 104 of the electric furnace 101, there was used a furnace wall having a surface which faced a furnace inner space and was provided with a plastered wall 110 having a thickness of about 0.2 mm. The plastered wall 110 was disposed by spraying a mixed slurry. This mixed slurry was prepared by mixing SiC grains (an average grain diameter of 100 μm) and water glass (2 wt % of $SiO_2$ in water glass with respect to 98 wt % of SiC) and further mixing 1% polyvinyl pyrrolidone (PVP) by external blending on the surface of an alumina insulating material 109 (a thickness of 200 mm and a porosity of 60%) on the side of a furnace inner space 102. Heaters 103 were installed on in-furnace wall surfaces 108 of the furnace walls 104 of all four surfaces constituting side surfaces, respectively. A furnace temperature control thermocouple 105 was disposed in the center of the furnace wall 104 on a ceiling side. An effective inner dimension of the electric furnace 101 was width 500×depth 500×height 500 mm. It is to be noted that refer to FIG. 6 for the thermal emissivity of the plastered wall 110 made of silicon carbide (the thermal emissivities of a material made of SiC=98 mass % and $SiO_2$=2 mass % at a wavelength of 1.6 to 2.6 μm at ordinary temperature (25° C.) and high temperature (1000° C.) are from about 0.8 to 0.9).

(2) Shelf Assembly

In the furnace inner space 102, two shelf assemblies 113 each obtained by stacking alumina shelf plates 111 in 20 stages via supporters were arranged in the furnace inner space 102 (FIG. 23). As the alumina shelf plates 111, shelf plates having a porosity of 60% and width 200×length 300×height 10 mm were used. As the supporters, 10 mm cubes made of the same alumina material as that of the shelf plates 111 were used. In the shelf assembly 113, a thermocouple 107 was installed on each of right and left sides on the shelf plates 111 of first, tenth and twentieth stages (six thermocouples 107 were installed in one shelf assembly 113).

(3) Temperature Rise Setting

Temperature rise conditions were set so that the ambient temperature in the furnace inner space 102 was raised from ordinary temperature (25° C.) to 1400° C. After the ambient temperature in the furnace inner space 102 reached 1400° C., the ambient temperature of 1400° C. was kept as it was. A temperature distribution in the shelf assembly 113 (each assembly) was measured by the six thermocouples 107 described above. A temperature rise program of the ambient temperature in the furnace was set so that the temperature distribution in the shelf assembly 113 was 12° C. when the ambient temperature in the furnace inner space 102 was 1400° C. Therefore, when the maximum allowable value of the temperature distribution in the shelf assembly 113 at the ambient temperature of 1400° C. in the furnace inner space 102 was 12° C., the temperature rise was controlled so that the temperature distribution at the in-furnace ambient temperature of 1400° C. was 1.0 time the maximum allowable value.

Table 1 shows an integral power consumption (kWh) required for temperature rise until the in-furnace ambient temperature reached 1400° C. from ordinary temperature (25° C.), time (h) required until the in-furnace ambient temperature reached 1400° C. from ordinary temperature (25° C.), the temperature distribution (° C.) in the shelf assembly 113 when the ambient temperature reached 1400° C., and a power (kW) required for holding the ambient temperature of 1400° C. after the in-furnace ambient temperature reached 1400° C. in Reference Example 1.

TABLE 1

| | Integral power consumption for temperature rise from ordinary temperature (25° C.) to 1400° C. (kWh) | Temperature distribution ΔT at ambient temperature of 1400° C. (° C.) | Time for temperature rise from ordinary temperature (25° C.) to 1400° C. (h) | Power consumption for holding ambient temperature of 1400° C. (kW) |
|---|---|---|---|---|
| Reference Example 1 | 99.5 | 12 | 6.0 | 8.5 |
| Reference Example 2 | 112.0 | 12 | 7.5 | 8.5 |
| Reference Example 3 | 112.0 | 6 | 7.5 | 8.5 |

Reference Example 2

An operation method was performed in the same manner as in Reference Example 1 except that a plastered wall 110 was not disposed on furnace walls 104 of an electric furnace 101. It is to be noted that refer to FIG. 6 for the thermal emissivity of an alumina insulating material 109 (the thermal emissivities of the alumina material at a wavelength of 1.6 to 2.6 μm at ordinary temperature (25° C.) and high temperature (1000° C.) were from about 0.1 to 0.2). Results of Reference Example 2 are shown in Table 1.

Reference Example 3

An operation method was performed in the same manner as in Reference Example 1 except that a temperature rise program of an ambient temperature in a furnace inner space 102 was set so that a temperature distribution in a shelf assembly 113 at an ambient temperature of 1400° C. in the furnace inner space 102 was 6° C. When the maximum allowable value of the temperature distribution in the shelf assembly 113 at the ambient temperature of 1400° C. in the furnace inner space 102 was 12° C., the temperature rise was controlled so that the temperature distribution at the in-furnace ambient temperature of 1400° C. was 0.5 time the maximum allowable value. Results of Reference Example 3 are shown in Table 1.

In Reference Example 1, as compared with Reference Example 2, the integral power consumption required for the temperature rise until the in-furnace ambient temperature reached 1400° C. from ordinary temperature (25° C.) was decreased by about 11% (12.5 kWh), and time required until the in-furnace ambient temperature reached 1400° C. from ordinary temperature (25° C.) was reduced by 20% (1.5 h). Reference Examples 2 and 3 had an equal integral power consumption required for the temperature rise until the in-furance ambient temperature reached 1400° C. from ordinary temperature (25° C.), and equal time required until the in-furnace ambient temperature reached 1400° C. from ordinary temperature (25° C.)

The present invention can be utilized as a housing for heating and a use method of the structure, a heating jig and a use method of the heating jig, and an operation method of a heating device.

DESCRIPTION OF REFERENCE NUMERALS

1: housing for heating, 5: mounting part, 7: fixing part, 9: mounting face, 11: furnace (electric furnace), 12: furnace inner space, 13: heater, 14: furnace wall, 15: furnace temperature control thermocouple, 16: thermocouple, 17: in-furnace wall surface, 21: shelf assembly, 23, 23*a*, and 23*b*: shelf, 25: shelf plate, 27: receiving portion, 28: leg, 29: supporter, 31: article to be heated, 41: floor, 51, 51*a*, and 51*b*: shelf, 53, 53*a*, and 53*b*: shelf plate, 55, 55*a*, and 55*b*: mounting face, 57: supporter, 60: shelf assembly, 61: mounting face, 101: electric furnace, 102: furnace inner space, 103: heater, 104: furnace wall, 105: furnace temperature control thermocouple, 107: thermocouple, 108: in-furnace wall surface, 109: insulating material, 110: plastered wall, 111: shelf plate, 113: shelf assembly, 121: heating device, 122: storage section, 123: storage chamber, 124: inner wall surface, 125: wall part, 128: heating means, and 129: article to be heated.

What is claimed is:

1. An apparatus for heating articles to be heated in a furnace comprising: a plurality of units each including a mounting part and a holding part combined with the mounting part, wherein each of the plurality of mounting parts includes a mounting face on which articles to be heated are mounted, the mounting face being a portion of the surface of the mounting part, wherein the holding part of one of the units is detachably connected to another unit so that a plurality of units are stacked while maintaining a space between the mounting parts arranged in a vertical direction to the mounting surfaces of the mounting parts, wherein at least one of the plurality of mounting parts includes a mounting face that has a thermal emissivity which is different from that of the mounting face of at least one of the remaining mounting parts, wherein the thermal emissivity of the center portion of the mounting face is larger than that of a peripheral portion of the mounting face, and wherein each of the plurality of units can be individually arranged in the furnace.

2. The apparatus for heating according to claim 1, wherein the mounting part has a plate shape, and includes the mounting face on one of two front and back surfaces of the plate shape, and the plurality of mounting parts are stacked while a space is left between the mounting face of the one mounting part and the surface of the mounting part stacked above the one mounting part on a side opposite to the mounting face of the mounting part.

3. The apparatus for heating according to claim 2, wherein the mounting face of the mounting part having the plate shape has a thermal emissivity which is equal to that of the surface of the mounting part opposite to the mounting face.

4. A use method of the apparatus for heating according to claim 1, comprising the steps of: in case of mounting the articles to be heated on the mounting faces of the mounting parts to house the articles to be heated in the apparatus for heating and heating the articles to be heated together with the apparatus for heating by heating means, stacking the plurality of mounting parts so that the ascending order of the size of the thermal emissivity of the mounting face of each of the mounting parts corresponds to the descending order of the rise or fall of an ambient temperature in a facing space of the mounting face, to use the mounting parts.

5. A use method of the apparatus for heating according to claim 1, comprising the steps of: mounting the articles to be heated on the mounting faces of the plurality of mounting parts to house the articles to be heated in the apparatus for heating while stacking the mounting parts so that the thermal emissivity of the mounting face of each of the mounting parts is not less than the thermal emissivity of the mounting face of the mounting part stacked above each of the mounting parts; storing the apparatus for heating in a storage chamber surrounded by a wall part; and raising an ambient temperature in the storage chamber to heat the articles to be heated together with the apparatus for heating.

6. An operation method of a heating device comprising the apparatus for heating according to claim 1, a storage section which stores the apparatus for heating in a storage chamber surrounded by a wall part having an inner wall surface made of a material having a thermal emissivity of 0.7 or more at a wavelength of 1.6 to 2.6 μm, ambient temperature measuring means for measuring an ambient temperature in the storage chamber, temperature distribution measurement means for measuring a temperature distribution in the article to be heated, and heating means for heating the inside of the storage chamber while controlling a temperature rise speed of the ambient temperature based on the ambient temperature measured by the ambient temperature measuring means and the temperature distribution measured by the temperature distribution measuring means, the method comprising the steps of: storing, in the storage chamber of the storage section, the apparatus for heating in which the articles to be heated are mounted; and heating the inside of the storage chamber by the heating means while controlling the temperature rise speed of the ambient temperature so that the temperature distribution in the article to be heated measured by the temperature distribution measuring means is from 0.9 to 1.0 time a maximum allowable value, when the ambient temperature measuring means measures the ambient temperature having the maximum allowable value of the temperature distribution in the article to be heated, which is determined so that any defect is not generated in the articles to be heated.

7. The operation method of the heating device according to claim 6, further comprising the steps of: raising the ambient temperature so that the temperature reaches 750° C. or higher.

8. The operation method of the heating device according to claim 6, wherein the inner wall surface is made of a material including at least two main components selected from the group consisting of SiC, $TiO_2$, TiO and $SiO_2$.

9. The operation method of the heating device according to claim 6, wherein the wall part includes an inner wall member constituting the inner wall surface, and a supporter with which the inner wall member is lined, and the inner wall member has a thickness of 0.1 to 3.0 mm and is made of a material containing at least two main components selected from the group consisting of SiC, $TiO_2$, TiO and $SiO_2$.

10. The apparatus for heating according to claim 1, wherein the plurality of units are stacked so that the ascending order of the amount of the thermal emissivity of the mounting face of each of the mounting parts corresponds to the descending order of the rise or fall of an ambient temperature in a facing space of the mounting face.

11. The apparatus for heating according to claim 1, wherein the plurality of units are stacked so that the thermal emissivity of the mounting face of each of the mounting parts is not less than the thermal emissivity of the mounting face of the mounting part stacked above each of the mounting parts.

12. The apparatus for heating according to claim 1, wherein the plurality of units are detachably connected without a separate connecting member used to connect the plurality of stacked units.

13. The apparatus for heating according to claim 1, wherein the mounting part is made of a first material and the center portion of one of two opposed surfaces of the mounting part is coated with a member made of a second material having a larger thermal emissivity than that of the first material.

14. The apparatus for heating according to claim 13, wherein an alumina material is used as the first material and a mixture of titanium oxide and silica is used as the second material.

* * * * *